US008813655B2

(12) United States Patent
Aspengen et al.

(10) Patent No.: US 8,813,655 B2
(45) Date of Patent: Aug. 26, 2014

(54) RAILROAD CAR CONSTANT CONTACT SIDE BEARING ASSEMBLY

(75) Inventors: Paul B. Aspengen, North Aurora, IL (US); Steve R. White, Maple Park, IL (US)

(73) Assignee: Miner Enterprises, Inc., Geneva, IL (US)

( * ) Notice: Subject to any disclaimer, the term of this patent is extended or adjusted under 35 U.S.C. 154(b) by 170 days.

(21) Appl. No.: 13/507,144

(22) Filed: Jun. 7, 2012

(65) Prior Publication Data

US 2013/0327245 A1 Dec. 12, 2013

(51) Int. Cl.
*B61F 5/14* (2006.01)

(52) U.S. Cl.
CPC ..... *B61F 5/14* (2013.01)
USPC ..... 105/199.3

(58) Field of Classification Search
CPC ..... B61F 5/142; B61F 5/14; B60G 2204/128
USPC ..... 105/199.3; 384/423
See application file for complete search history.

(56) References Cited

U.S. PATENT DOCUMENTS

| | | | | |
|---|---|---|---|---|
| 946,261 | A | 1/1910 | O'Connor | |
| 1,179,755 | A | 4/1916 | Price et al. | |
| 1,193,313 | A | 8/1916 | Townsend | |
| 1,233,348 | A | 7/1917 | Hansson | |
| 1,252,358 | A | 1/1918 | Miner | |
| 1,290,319 | A | 1/1919 | O'Connor | |
| 1,722,668 | A | 7/1929 | Lane | |
| 1,808,839 | A | 6/1931 | Davis | |
| 2,197,783 | A | 4/1940 | Barrows | |
| 2,259,608 | A | 10/1941 | Blattner | |
| 2,285,140 | A | 6/1942 | Barrows et al. | |
| 2,541,769 | A | 2/1951 | Keysor | |
| 2,571,190 | A | 10/1951 | Blattner | |
| 2,636,789 | A | 4/1953 | Blattner | |
| 2,830,857 | A | 4/1958 | Blattner | |
| 3,151,918 | A | 10/1964 | Bachman et al. | |
| 3,401,991 | A | 9/1968 | McDonnell | |
| 3,514,169 | A | 5/1970 | McDonnell | |
| 3,600,047 | A | 8/1971 | McDonnell | |
| 3,796,167 | A * | 3/1974 | Van Moss, Jr. | 105/199.3 |
| 4,924,779 | A | 5/1990 | Curtis et al. | |
| 5,086,707 | A | 2/1992 | Spencer et al. | |
| RE34,129 | E | 11/1992 | Wright | |
| 5,315,934 | A | 5/1994 | List et al. | |
| 5,601,031 | A * | 2/1997 | Carlson | 105/199.3 |
| 5,806,435 | A | 9/1998 | Pitchford | |
| 6,092,470 | A * | 7/2000 | O'Donnell | 105/199.3 |
| 6,644,214 | B1 | 11/2003 | Schorr | |
| 6,792,871 | B2 | 9/2004 | O'Donnell et al. | |
| 6,957,611 | B2 | 10/2005 | O'Donnell et al. | |
| 7,044,061 | B2 * | 5/2006 | O'Donnell et al. | 105/199.3 |
| 7,152,534 | B2 | 12/2006 | O'Donnell et al. | |
| 7,275,487 | B2 | 10/2007 | O'Donnell et al. | |

(Continued)

*Primary Examiner* — Mark Le
(74) *Attorney, Agent, or Firm* — Law Office of John W. Harbst

(57) ABSTRACT

A railroad car constant contact side bearing assembly including a housing, a top cap arranged for vertical reciprocatory movements relative to the housing, and a spring accommodated in a spring cavity defined by the housing and cap for resiliently urging the top cap into frictional sliding engagement with an underside of a railcar body. At least one of the side bearing housing and cap is formed from a high performance plastic material whereby enhancing the vertical reciprocity of the cap relative to the housing.

27 Claims, 12 Drawing Sheets

(56) References Cited

U.S. PATENT DOCUMENTS

| | | | | |
|---|---|---|---|---|
| 7,325,499 | B2 | 2/2008 | Jensen et al. | |
| 7,338,034 | B2 | 3/2008 | Aspengren et al. | |
| 7,784,410 | B2 | 8/2010 | O'Donnell et al. | |
| 7,802,524 | B1 | 9/2010 | Gregar | |
| 8,201,504 | B2 | 6/2012 | O'Donnell et al. | |
| 8,534,202 | B2 * | 9/2013 | McKisic et al. | 105/199.3 |
| 2006/0117985 | A1 | 6/2006 | Forbes et al. | |
| 2007/0069435 | A1 * | 3/2007 | Aspengren et al. | 267/293 |
| 2009/0308276 | A1 | 12/2009 | Aitken et al. | |
| 2010/0294165 | A1 * | 11/2010 | Sprainis et al. | 105/199.3 |

* cited by examiner

RAILROAD CAR CONSTANT CONTACT SIDE BEARING ASSEMBLY

FIELD OF THE INVENTION DISCLOSURE

The present invention disclosure generally relates to railroad cars and, more specifically, to a constant contact side bearing assembly for a railroad car.

BACKGROUND

A typical railroad freight car includes a car body supported on a pair of wheeled trucks which are confined to roll on rails or tracks. Each truck includes a bolster extending essentially transversely of the car body longitudinal centerline. In the preponderance of freight cars, a pivotal connection is established between the bolster and railcar body by center bearing plates and bowls transversely centered on the car body underframe and the truck bolster. Accordingly, the truck is permitted to pivot on the center bearing plates under the car body. As the railcar moves between locations, the car body also tends to adversely roll from side to side.

Attempts have been made to control the adverse roll of the railcar body through use of side bearings positioned on the truck bolster outwardly of the center bearing plate. A "gap style" side bearing has been known to be used on slower moving tank/hopper railcars. Conventional "gap style" side bearings include a metal, i.e. steel, block or pad accommodated within an elongated open top pocket or recess defined on the truck bolster. An elongated and upstanding housing or cage, integrally formed with or secured, as by welding or the like, to an upper surface on the truck bolster defines the open top recess and inhibits sliding movement of the metal block relative to the bolster. As is known, a gap or vertical space is usually present between the upper surface of the "gap style" side bearing and the underside of the railcar body.

Other conventional "gap style" side bearings have included roller bearings carried for rolling movements within the elongated housing or carrier mounted on the upper surface of the railcar bolster. The roller extends above an uppermost extent of the housing or carrier and engages with an underside of the railcar body. Such side bearings are able to support the railcar body with respect to the bolster while at the same time permitting the bolster, and therefore the truck, freedom to rotate with respect to the car body as is necessary to accommodate normal truck movements along both straight and curved track.

Under certain dynamic conditions, coupled with lateral track irregularities, the railcar truck also tends to adversely oscillate or "hunt" in a yaw-like manner beneath the car body. The coned wheels of each truck travel a sinuous path along a tangent or straight track as they seek a centered position under the steering influence of the wheel conicity. As a result of such cyclic yawing, "hunting" can occur as the yawing becomes unstable due to lateral resonance developed between the car body and truck. Excessive "hunting" can result in premature wear of the wheeled truck components including the wheels, bolsters, and related equipment. Hunting can also furthermore cause damage to the lading being transported in the car body.

Track speeds of rail stock, including tank/hopper cars, continue to increase. Increased rail speeds translate into corresponding increases in the amount of hunting movements of the wheeled trucks. "Gap style" or those side bearings including roller bearings simply cannot and do not limit hunting movements of the wheeled trucks. As such, the truck components including the wheels, bolsters, and related equipment tend to experience premature wear.

The art has also contemplated constant contact side bearings for railcars. Constant contact railcar side bearings not only support a railcar body with respect to the bolster during relative rotational movements therebetween but additionally serve to dissipate energy through frictional engagement between the underside of the railcar body and a bearing element thereby limiting destructive truck hunting movements. Constant contact side bearings typically include a housing assembly including a base and a cap. The base usually has a cup-like configuration and includes at least two apertured flanges, extending in opposed radial directions relative to each other, permitting the base to be suitably fastened to the bolster. In one form, the cap is biased from the base and includes an upper surface for contacting and rubbing against a car body underside. The cap must be free to vertically move relative to the side bearing base.

Such constant contact side bearings furthermore include a spring. The purpose of such spring is to absorb, dissipate, and return energy imparted thereto during a work cycle of the side bearing assembly and resiliently position the upper surface of the cap, under a preload force, into frictional contact with the car body underframe. The spring for such side bearings can comprise either spring loaded steel elements or elastomeric blocks or a combination of both operably positioned between the side bearing base and the cap. An elastomeric block which has been found particularly beneficial is marketed and sold by the Assignee of the present invention disclosure under the tradename "TecsPak." As will be appreciated, however, such an elastomeric block, by itself, lacks longitudinal stiffness and, thus, requires surrounding housing structure to provide added support and stiffness thereto.

There are several challenges presented in connection with the design of a constant contact side bearing assembly. First, and during the course of operation, the clearance between the base and cap of a constant contact side bearing housing assembly becomes enlarged due to abrasion and wear. Such wear is a critical detractor to side bearing assembly performance. That is, a gap or space between the base and cap of the side bearing housing assembly adversely permits longitudinal or horizontal shifting movements of the cap relative to the housing thereby reducing the energy absorption capability for the side bearing assembly—a critical operating criteria for the side bearing assembly. Of course, when the gap or space between the base and cap of the side bearing housing assembly reaches a critical limit, the side bearing assembly is no longer useful and will be condemned.

During operation of the railcar side bearing assembly, and while controlling any clearance or gap between the cap and housing of the side bearing assembly so as to limit horizontal shifting movements of the cap relative to the housing remains advantageous, the cap must remain able to vertically reciprocate relative to the housing. As will be appreciated, if the cap cannot vertically reciprocate during operation of the side bearing assembly, the primary purpose and function of the constant contact side bearing assembly will be lost.

Another design challenge involved with those constant contact side bearings using an elastomeric spring relates to the buildup of heat in proximity to the elastomeric spring. During operation of the railcar, frictional contact between the railcar body and the side bearing assembly results in the development of heat buildup. Unless such heat buildup can be controlled, the elastomeric spring will tend to soften and deform, thus, adversely affecting the operable performance of the constant contact side bearing assembly.

The frictional sliding relationship between the side bearing assembly and the related railcar component can create temperatures within the side bearing assembly that can exceed the heat deflection temperature of the elastomeric spring thus causing the elastomeric spring to deform. As used herein and throughout, the term "heat deflection temperature" means and refers to a temperature level at the which the elastomeric spring, regardless of its composition, tends to soften and deform. Deformation of the elastomeric spring can significantly reduce the ability of the elastomeric spring to apply a proper preload force and, thus, decreases vertical suspension characteristics of the side bearing assembly which, in turn, results in enhanced hunting of the wheeled truck. Enhanced hunting and/or unstable cyclic yawing of the truck increases the resultant translation/oscillation of the railcar leading to a further increase in the heat buildup and further deterioration of the elastomeric spring.

Thus, there is a continuing need and desire for a railcar constant contact side bearing assembly having components which are designed to optimize energy absorption and related performance criteria for the side bearing assembly while maintaining vertical reciprocity of the cap relative to the housing while furthermore inhibiting deterioration of an elastomeric spring resulting from localized heat.

SUMMARY

According to one aspect of this invention disclosure, there is provided a railroad car constant contact side bearing assembly including a housing and a non-metallic cap. The side bearing housing includes upstanding wall structure defining a central axis for the side bearing assembly. The non-metallic cap is arranged for generally coaxial movement relative to the housing and has a generally flat upper surface extending beyond the upper end of the housing wall structure. Moreover, the cap includes wall structure depending from the generally flat upper surface. The cap wall structure combines with the housing wall structure for guiding the cap for generally axial vertical movements. A spring is accommodated within a cavity operably defined by the wall structures of the housing and cap. A metallic insert is maintained in operable association with the generally flat surface on said cap to slidably contact with an underside of said railcar whereby allowing said side bearing assembly to establish a coefficient of friction ranging between about 0.4 and about 0.9 with the railcar during operation of said constant contact side bearing assembly.

Preferably, the insert maintained in operable association with the cap is formed from a metal material selected from the class of: steel and austempered ductile iron. In one form, the housing and said cap preferably define cooperating instrumentalities for guiding the cap for vertical reciprocatory movements relative to said housing and for maintaining a predetermined relation between the cap and the housing.

In this family of embodiments, the spring for the side bearing assembly includes an elastomeric member having first and second axially aligned ends. Preferably, the housing includes a base with generally horizontal flange portions extending in opposite directions and away from the central axis of the side bearing assembly, with each flange portion defining an aperture therein. Moreover, the housing preferably includes a post extending upwardly from the base for a predetermined distance. In this form, the insert on the cap includes a depending post generally aligned with the post of the housing for limiting reciprocatory movement of the cap toward the housing during operation of the railroad car constant contact side bearing assembly.

According to another aspect of this invention disclosure, there is provided a railroad car constant contact side bearing assembly adapted to be disposed intermediate a bolster and a car body of a railroad vehicle. In this family of embodiments, the side bearing assembly includes a cap having a generally planar upper surface configured to contact and slide along an underside of the car body and wall structure formed integral with and depending from the generally planar surface so as to define the cap with an open-bottom cavity. A spring is provided for continually urging the generally planar surface on the cap into sliding contact with the underside of the car body. A housing formed from high performance plastic has an open-top upstanding wall structure defining a non-metal sliding surface which guides and promotes vertical reciprocatory movements of the wall structure of the cap relative to the housing. The open-top wall structure of the housing and the open-bottom wall structure of the cap combine to define a cavity wherein the spring is accommodated. A metal skeleton is arranged in operable combination with the plastic housing. The skeleton preferably includes a base and wall structure extending upwardly from the base and embedded within and adding strength to the upstanding wall structure of the housing. The base of the metal skeleton defines two apertures on opposed sides of the side bearing assembly central axis for allowing fasteners to pass therethrough so as to allow the side bearing assembly to be secured to an upper surface of a bolster on said railcar.

In one form, the housing and cap of the side bearing assembly define cooperating instrumentalities for guiding the cap for vertical reciprocatory movements relative to the housing and for maintaining a predetermined relation between the cap and housing. Preferably, the wall structure of the skeleton includes at two vertically upright projections extending from and formed integral with the skeleton base. Each projection on the skeleton terminates at an upper end of the wall structure on the housing for limiting reciprocatory movement of the cap toward the housing during operation of said railroad car constant contact side bearing assembly.

In one embodiment, the spring is formed from a thermoplastic elastomer. As such, the the cap wall structure defines openings arranged toward an intersection of the generally planar surface and the wall structure so as to remain substantially unobstructed by the underside of said railcar body during operation of said side bearing assembly. The openings in the cap dissipate heat away from the spring during operation of said side bearing assembly. In a preferred form, the plastic housing also defines openings toward a bottom thereof and which are arranged in communication with the cavity defined by the side bearing assembly. The openings in the plastic housing and the openings in the cap define an air passage between the bottom of the housing and the openings in the cap to promote the dissipation of heat away from said elastomeric spring during operation of said side bearing assembly.

According to another aspect of this invention disclosure, there is provided a railroad car constant contact side bearing assembly adapted to be disposed intermediate a bolster and a car body of a railroad vehicle. The side bearing assembly includes a cap having a generally planar surface configured to contact and slide along an underside of the car body. The cap further includes wall structure formed integral with and depending from the generally planar surface so as to define an open-bottom cavity. A spring continually urges the generally planar surface on the cap into sliding contact with the underside of the car body. The side bearing assembly furthermore includes a housing formed from high performance plastic. The housing has an open-top cavity defined by upstanding wall structure. The housing wall structure defines a non-metal sliding surface which guides and promotes vertical reciprocatory movements of the wall structure of the cap relative to the housing. The open-top wall structure of the housing and the open-bottom wall structure of the cap combining to define a cavity wherein the spring is accommodated. In this embodiment, a metal skeleton is arranged in operable combination with the plastic housing. The skeleton includes a two-piece structure. Each skeletal piece includes a base and a projection extending upwardly from the base and embedded within and adding strength to a segment of the upstanding wall structure of the side bearing assembly housing. The base of each skeletal part defines an aperture for allowing a fastener to pass therethrough so as to allow the side bearing assembly to be secured to an upper surface of the bolster on the railcar.

Preferably, the housing and cap define cooperating instrumentalities for guiding the cap for vertical reciprocatory movements relative to the housing and for maintaining a predetermined relation between the cap and the housing. Moreover, the projection on each piece of the two-piece structure terminates at an upper end of the wall structure on the housing for limiting reciprocatory movement of the cap toward the housing during operation of the railroad car constant contact side bearing assembly.

In this embodiment, the spring is preferably formed from a thermoplastic elastomer. As such, the side bearing assembly cap defines openings arranged toward an intersection of the generally flat surface and the wall structure of the cap. The openings in the cap remain substantially unobstructed by the underside of the railcar body during operation of the side bearing assembly. Additionally, the openings in the cap are preferably arranged in communication with the open-bottom cavity defined by the cap to dissipate heat from the cavity during operation of the side bearing assembly. Also, the plastic housing preferably defines openings toward a bottom thereof which are arranged in communication with the cavity defined by the housing. Those openings in the plastic housing and the openings in the cap define an air passage between the bottom of the housing and the openings in the cap to promote the dissipation of heat away from said elastomeric spring during operation of the side bearing assembly.

According to yet another aspect, there is provided a railroad car constant contact side bearing assembly adapted to be disposed intermediate a bolster and a car body of a railroad vehicle. The side bearing assembly includes a non-metallic cap having a generally planar upper surface and wall structure depending from said generally planar upper surface. The wall structure of the cap defines an open-bottom cavity. A metallic insert is maintained in operable association with the generally flat surface on the cap to slidably contact with an underside of the railcar whereby allowing the side bearing assembly to establish a coefficient of friction ranging between about 0.4 and about 0.9 with the railcar during operation of the constant contact side bearing assembly. The side bearing assembly furthermore includes a housing formed from high performance plastic and having an open-top upstanding wall structure defining a non-metal sliding surface which guides and promotes vertical reciprocatory movements of the wall structure of the cap relative to the housing. The open-top wall structure of the housing and the open-bottom wall structure of the cap combine to define a recess wherein a spring is accommodated for urging the cap toward an underside of the car body. A metal skeleton is arranged in operable combination with the plastic housing. The metal skeleton includes wall structure embedded within and adding strength to the upstanding wall structure of the housing. The metal skeleton defines two apertures for allowing fasteners to pass therethrough so as to allow the side bearing assembly to be secured to an upper surface of the bolster on said railcar.

Preferably, the insert that is maintained in operable association with the cap is formed from a metal material selected from the class of: steel and austempered ductile iron. Moreover, the housing and the cap define preferably define cooperating instrumentalities for guiding the cap for vertical reciprocatory movements relative to the housing and for maintaining a predetermined relation between the cap and the housing.

In one form, the spring includes an elastomeric member having first and second axially aligned ends. The metal skeleton of the side bearing assembly preferably includes an elongated base and a post extending upwardly from base for a predetermined distance. The base preferably defining two apertures for allowing a fastener to pass through each aperture whereby securing the side bearing assembly to an upper surface of the bolster on the railcar. Also, the insert on the cap further includes a depending post generally aligned with the post of the skeleton for limiting reciprocatory movement of the cap toward the housing during operation of the railroad car constant contact side bearing assembly.

In one embodiment, the skeleton includes a two-piece structure. Each piece of the skeleton includes a base and a projection extending upwardly from the base and embedded within and adding strength to a segment of the upstanding wall structure of the housing. The base of each two piece structure defines an aperture for allowing a fastener to pass therethrough so as to allow the side bearing assembly to be secured to an upper surface of the bolster on said railcar.

Preferably, the spring for the side bearing assembly is formed from a thermoplastic elastomer. When the spring is formed from a thermoplastic elastomer, the side bearing assembly cap defines preferably openings arranged toward an intersection of the generally planar surface and the wall structure of the cap. The openings in the cap remain substantially unobstructed by the underside of the railcar body during operation of the side bearing assembly. Also, the openings in the cap are in communication with the open-bottom cavity defined by the cap to dissipate heat from the cavity during operation of the side bearing assembly. In a preferred form, the plastic housing defines openings toward a bottom thereof and which are arranged in communication with the open-top cavity defined by the housing. The openings in the plastic housing and the openings in the cap combine to define an air passage between the bottom of the housing and the openings in the cap to promote the dissipation of heat away from said elastomeric spring during operation of said side bearing assembly.

According to still another aspect, there is provided a railroad car constant contact side bearing assembly plastic cap including a generally flat surface with wall structure formed integral with and depending from the generally flat surface. The wall structure combines with an underside of the generally flat surface to define an open-bottom cavity for the cap. A metallic insert is maintained in operable association with the generally flat surface on the cap to slidably contact with an underside of a railcar whereby permitting the cap to establish a coefficient of friction ranging between about 0.4 and about 0.9 with the railcar. The side bearing cap further defines a plurality of openings for allowing air to pass into and from the open-bottom cavity. The openings are defined by the side bearing assembly cap in the vicinity of an intersection between the generally flat surface and the wall structure of the cap for allowing the dissipation of heat from said open-bottom cavity defined by the cap.

In this embodiment, the plurality of openings defined by the cap includes at least two openings which are generally aligned relative to each other. Preferably, the metallic insert is defined by a class of materials including: steel and austempered ductile iron. In one form, the metallic insert includes a generally centralized post depending from an underside of the generally flat surface on the cap. In a preferred form, at least an axial section of the cap wall structure depending from the generally flat surface on the cap has a generally cylindrical configuration.

DETAILED DESCRIPTION

Figure 1:
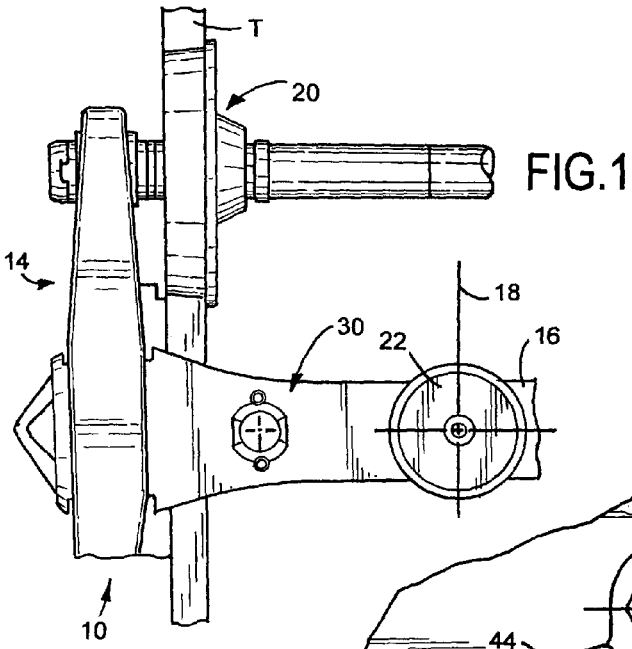
FIG. 1 is a top plan view of a portion of a railroad car wheeled truck including one form of a constant contact side bearing assembly embodying principals of this invention disclosure.

While this invention disclosure is susceptible of embodiment in multiple forms, there is shown in the drawings and will hereinafter be described preferred embodiments of this invention disclosure, with the understanding the present disclosure is to be considered as setting forth exemplifications of the disclosure which are not intended to limit the disclosure to the specific embodiment illustrated and described.

Figure 3:
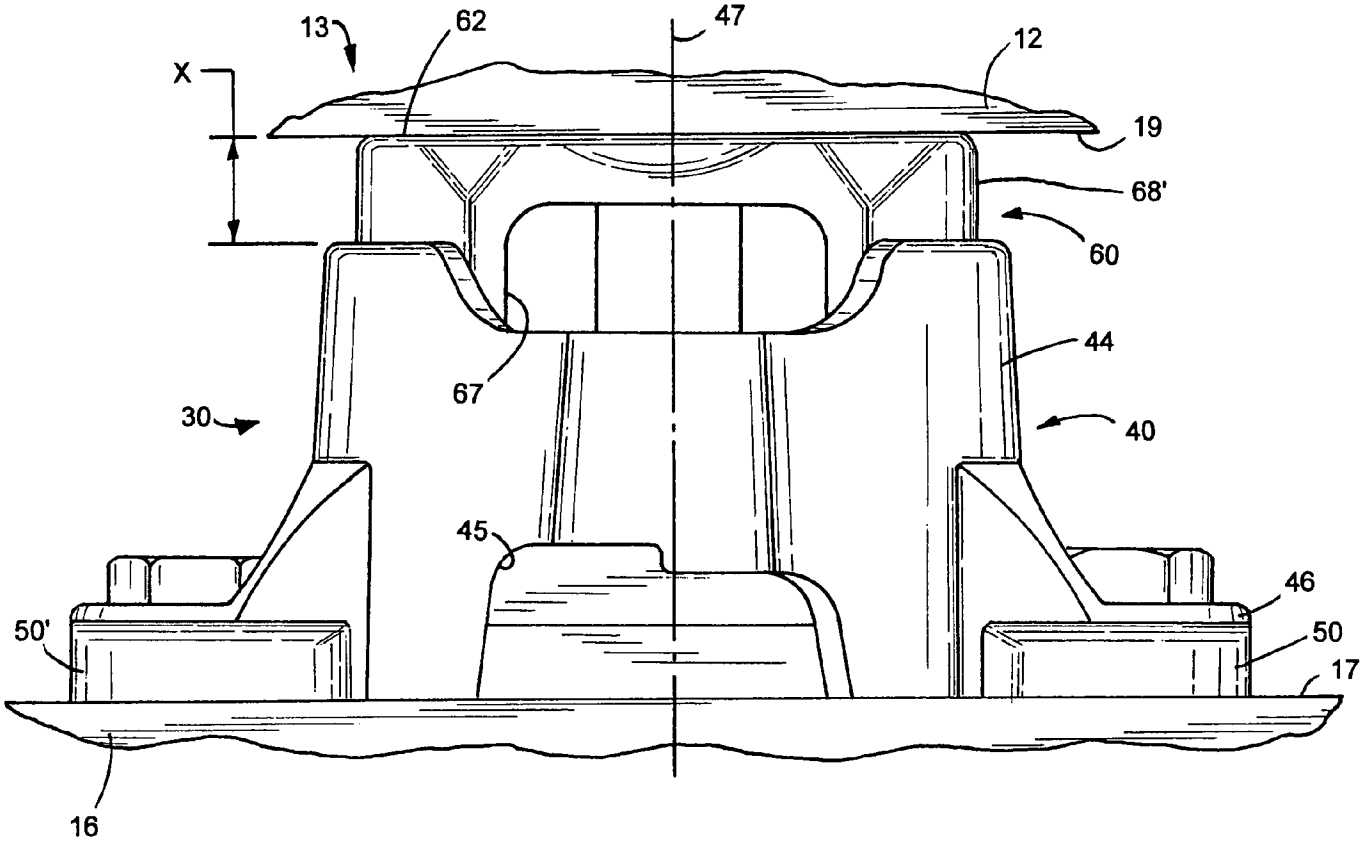
FIG. 3 is an elevation view of the side bearing assembly illustrated in FIG. 2.

Referring now to the drawings, wherein like reference numerals indicate like parts throughout the several views, FIG. 1 shows a fragment of a railcar wheeled truck assembly, generally indicated by reference numeral 10, for supporting and allowing a railcar body 12 defining a part of a railcar 13 (FIG. 3) to ride along and over tracks T. Truck assembly 10 is of a conventional design and includes a side frame 14, a bolster 16, extending generally transversely relative to a longitudinal centerline 18 of the railcar body 12 (FIG. 3), and a wheel set 20. A conventional center bearing plate 22 is suitably mounted on the bolster 16 for pivotally supporting one end of the car body 12 (FIG. 3).

A railroad car constant contact side bearing assembly embodying principals of this invention disclosure is generally indicated in FIG. 1 by reference numeral 30 and is arranged in operable combination with each wheeled truck assembly 10. More specifically, and as is conventional, the railroad car constant contact side bearing assembly 30 is mounted on an upper surface 17 (FIGS. 2, 3 and 4) of the railcar bolster 16 on opposite lateral sides of the center bearing plate 22 (FIG. 1) to limit hunting movements and oscillation of the wheeled truck assembly 10 as the railcar moves over the tracks T.

Figure 2:
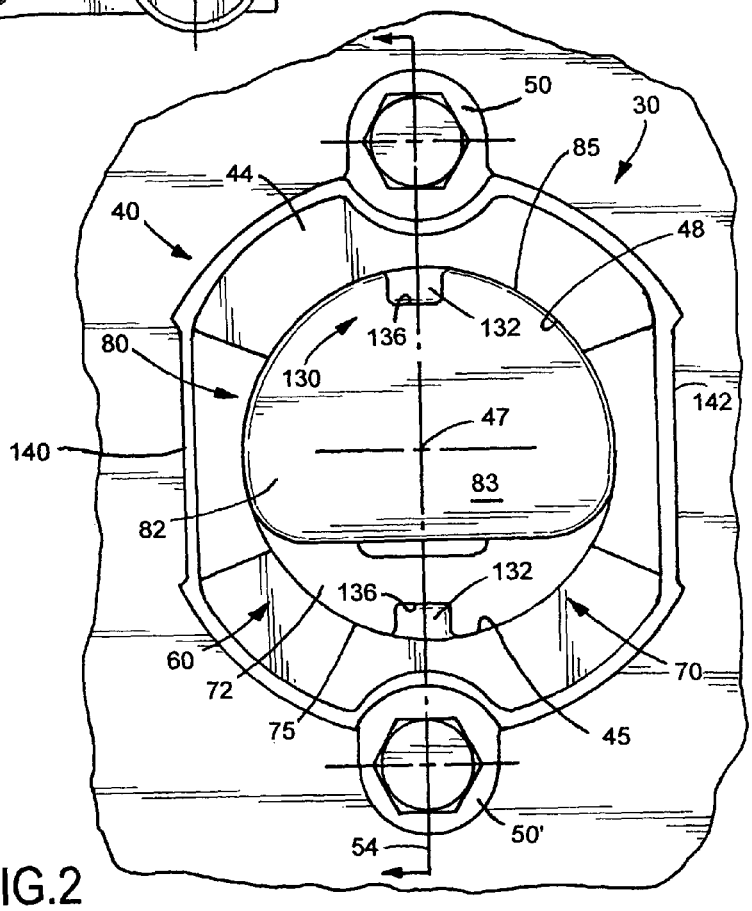
FIG. 2 is an enlarged top plan view of one form of constant contact side bearing assembly embodying principals and teachings of this invention disclosure.
Figure 4:
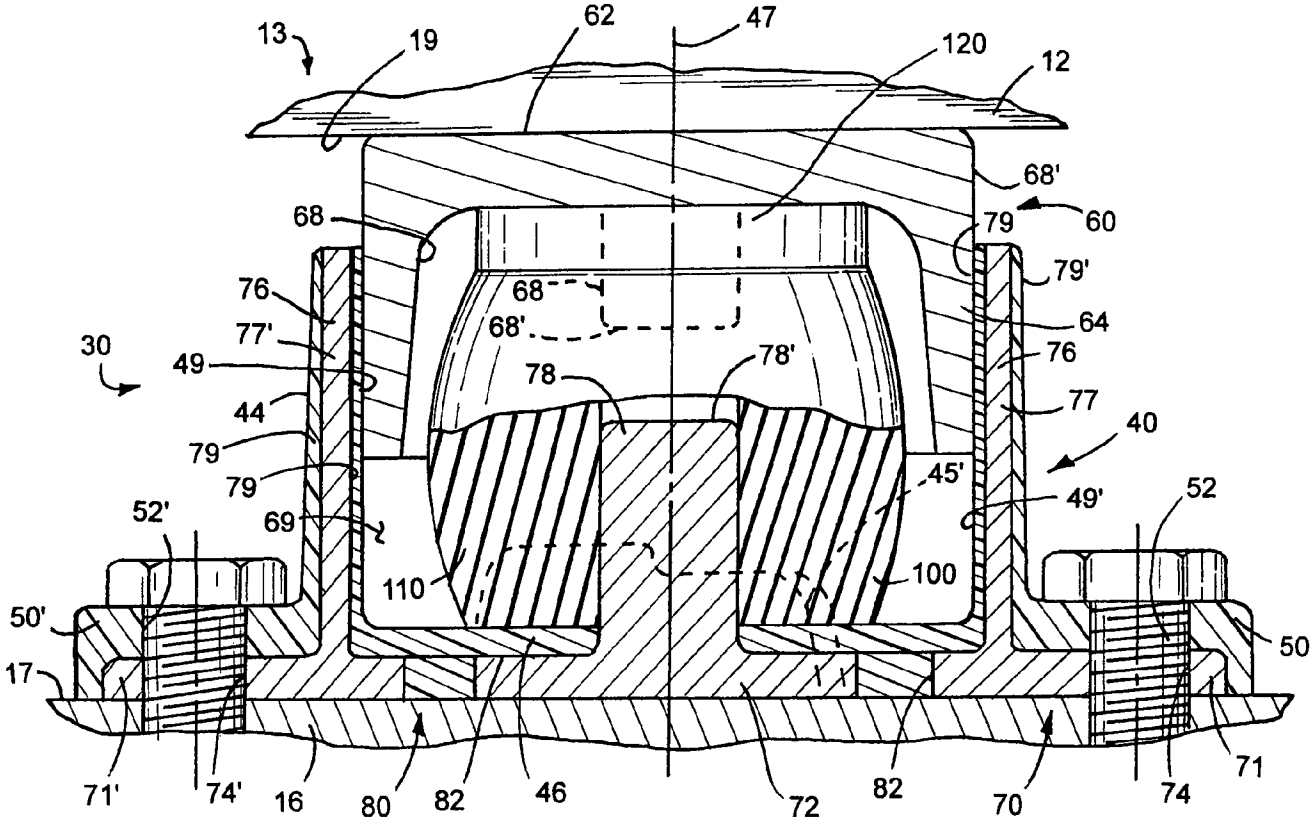
FIG. 4 is a longitudinal sectional view of the side bearing assembly taken along line 4-4 of FIG. 2.

The aesthetic design of the side bearing assembly 30 shown in the drawings is merely for exemplary purposes. Whereas, the principals and teachings set forth below are equally applicable to side bearings having other forms and shapes from that illustrated for exemplary purposes. Turning to FIGS. 2 and 3, the railcar constant contact side bearing assembly 30 includes a housing or cage 40, a cap 60 arranged for generally telescoping or vertical reciprocatory movements relative to the housing 40, and a spring 100 (FIG. 4).

In the embodiment shown in FIGS, 2, 3 and 4, housing 40 includes wall structure 44 extending upwardly from the base 46 for a predetermined distance and defines an axis 47 for the side bearing assembly 30. The interior surface 49 of the housing wall structure 44 defines an open-top cavity or internal void 48.

The housing base 46 is configured for suitable attachment to the upper surface 17 of the railcar bolster 16 as through any suitable means, i.e. threaded bolts or the like. In the illustrated embodiment, housing base 46 includes a pair of mounting flanges 50 and 50' radially extending outwardly in opposed directions away from the side bearing assembly axis 47. Each mounting flange 50, 50' defines a bore or aperture 52, 52' (FIG. 4), respectively, for allowing a suitable fastener to extend therethrough whereby permitting the housing 40 to be fastened to the upper surface 17 of the bolster 16. Preferably, the bores or apertures 52, 52' are aligned relative to each other along a longitudinal axis 55 (FIG. 2) such that, when housing 40 is secured to the bolster 16, axis 55 extends generally parallel to the longitudinal axis 18 of car body 12 (FIG. 1). In the embodiment illustrated in FIGS. 2, 3 and 4, the cap or member 60 is preferably formed from a strong and rigid metal such as steel and the like and is adapted to telescopically move relative to the housing 40. A top plate 62 of cap 60 has a generally planar or flat configuration for frictionally engaging and establishing metal-to-metal sliding contact with an underside 19 or surface of the railcar body 12 (FIGS. 3 and 4).

When the side bearing assembly 30 is secured to the bolster 16, the generally flat surface of top plate 62 is disposed above a terminal end of the upstanding wall structure 44 of the side bearing housing 40 for a predetermined distance. In the example shown, the normal distance between the top plate 62 of cap or member 60 and a top of the housing wall structure 44, indicated by the distance "X" in FIG. 3, is determinative of the permissible compressive movement of the side bearing assembly 30 and such that after the underside 19 of the railcar body 12 contacts the housing structure 44, the side bearing assembly 30 functions as a solid unit and prevents further rocking and relative movement between the bolster 16 and the railcar body 12.

In the illustrated embodiment, cap 60 includes wall structure 64 depending from and, preferably, formed integral with the top plate 62 to define an open-bottom cavity 68. At least a portion of the wall structure 64 of cap 60 is positioned within the housing 40 for generally vertical reciprocatory movements. Moreover, in a preferred embodiment, at least an axial section of the wall structure 64 of cap 60 has a generally cylindrical cross-sectional configuration.

Figure 8:
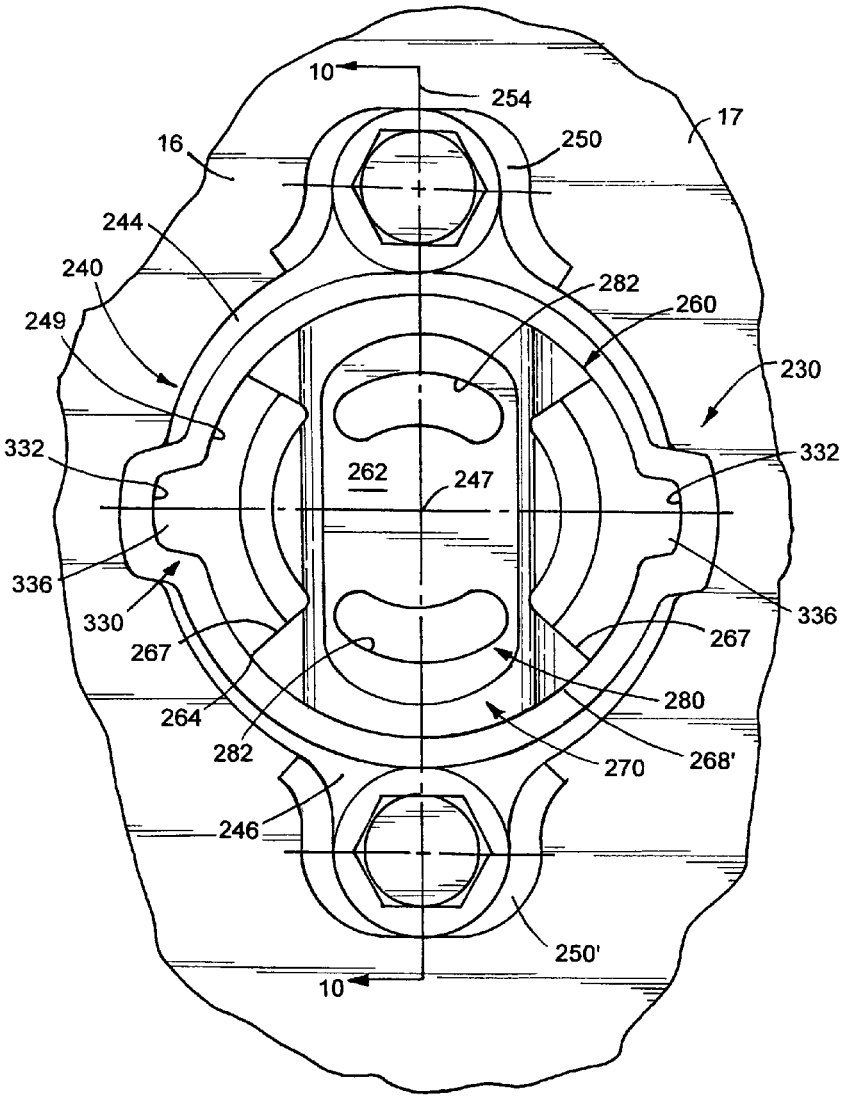
FIG. 8 is an enlarged top plan view of another embodiment of constant contact side bearing assembly embodying principals and teachings of this invention disclosure.

As shown in FIG. 2, an outer surface 68' of the wall structure 64 of cap 60 complements an inner surface 49' defined by the wall structure 44 of the side bearing housing 40 Moreover, and as shown in FIG. 8, the open-top wall structure 44 of the side bearing housing 40 and the open-bottom wall structure 68 of cap 60 operably combine to surround the spring 100 and define a void 69 wherein spring 100 is accommodated. As will be appreciated, if the wall structure 44 of housing 40 is designed with other than a generally round cross-sectional configuration, the cross-sectional configuration of the wall structure 64 of cap 60 would similarly change and vice versa.

According to one aspect of this invention disclosure, and as illustrated in FIG. 4, the housing 40 is formed from a high performance plastic material to enhance vertical reciprocity of the cap 60 relative to the housing 40. In this embodiment, housing 40 is formed from a non-metal, high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto. Besides being less weight than steel, forming the housing 40 from such non-metal, high performance plastic material has also shown lower wear rates between the sliding surfaces or contact areas with cap 60 which, in turn, increases the expectant life of the side bearing assembly 30.

To add strength and rigidity thereto, a metal skeleton 70 is arranged in operable combination with and forms and integral part of housing 40. Skeleton 70 is preferably formed from a strong and rigid metal material selected from the class of: steel and austempered ductile iron whereby enabling the wall structure of housing 40 to absorb the relatively high impact loads and forces directed thereagainst during operation of the side bearing assembly 30.

Figure 5:
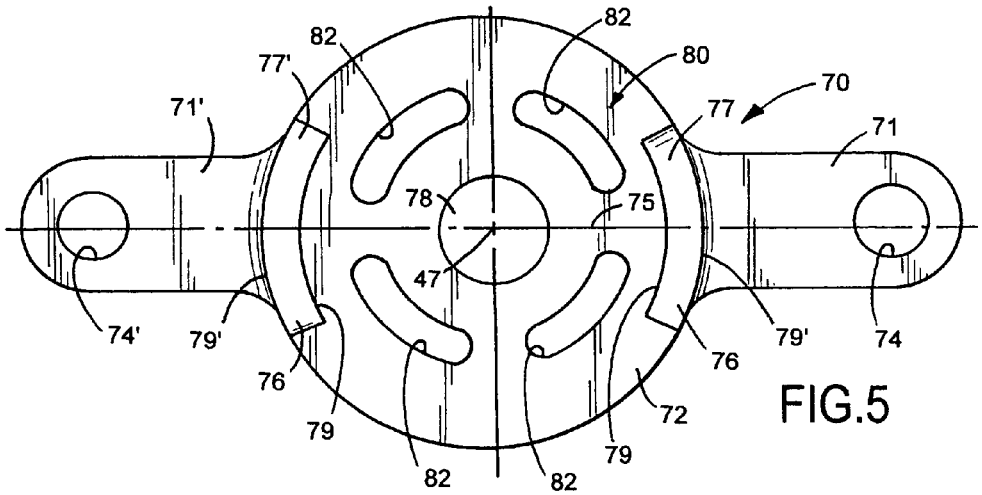
FIG. 5 is a top plan view of one embodiment of a metal skeleton forming part of a housing of the side bearing assembly illustrated in FIG. 2
Figure 6:
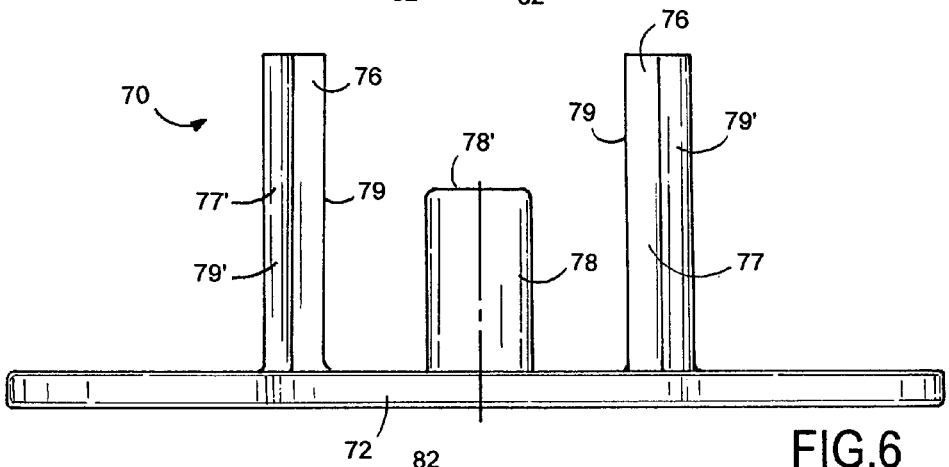
FIG. 6 is a side elevational view of the metal skeleton shown in FIG. 5.

In the form shown by way of example in FIGS. 4, 5 and 6, the skeleton 70 includes an elongated base 72 having a pair of mounting flanges 71 and 71" radially extending outwardly in opposed directions relative to each other. Each mounting flange 71, 71' defines a bore or aperture 74, 74' (FIG. 5), respectively, for allowing a suitable fastener to extend therethrough whereby permitting the housing 40 to be fastened to the upper surface 17 of the bolster 16. Like the bores or apertures 52, 52', the bores or apertures 74, 74' in the metal skeleton 70 are aligned relative to each other along a longitudinal axis 75. Moreover, the longitudinal spacing between the bores 74, 74' defined by the skeleton 70 is equal to the longitudinal spacing between the bores 52, 52' in the side bearing housing 40.

Skeleton 70 of housing 40 furthermore includes wall structure 76 extending upwardly from the base 72 and embedded within and adding strength and rigidity to the plastic wall structure 44 of housing 40. In the embodiment shown in FIG. 4, the wall structure 76 of skeleton 70 preferably extends upwardly from the base 72 and terminates at or adjacent to a terminal end of the wall structure 44 of housing 40. Preferably, the wall structure 76 of skeleton 70 is formed integral with the base 72. In one form, and for reasons discussed below, the wall structure 76 of skeleton 70 includes two radially spaced upstanding wall structures 77, 77' which extend partially around the wall structure 44 of housing 40 a sufficient distance whereby enabling the wall structure 44 of housing 40 to absorb the relatively high impact forces and loads directed thereagainst during operation of the side bearing assembly 30.

In the illustrated embodiment, and when the wall structure 44 of the side bearing housing 40 has a generally cylindrical cross-sectional configuration, the wall structure 76 of skeleton 70 will also have a generally arcuate or radiused configuration, in plan, on at least an inner surface 79 and preferably an outer surface 79' of each wall structure 77, 77'. Preferably, the sides or surfaces 79, 79' of each wall structure 77, 77' are disposed in generally concentric relation relative to the wall structure 44 of housing 40. Suffice it to say, in this embodiment of the invention disclosure, the outer surface 69' of the metal cap 60 is separated from the inner surface 49' of the housing 40 and from the inner surface 79 of the skeletal wall structure 76 by high performance plastic material to enhance vertical reciprocity of the cap 60 relative to the housing 40.

Figure 7:
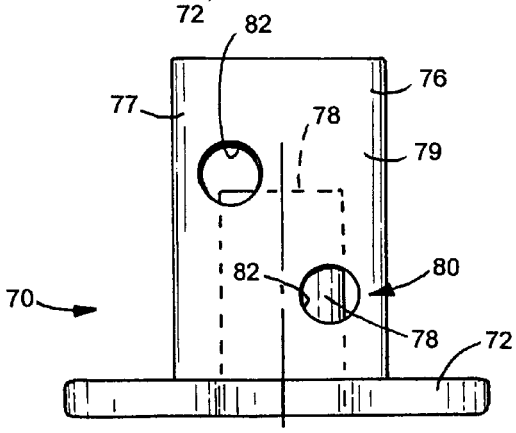
FIG. 7 is an end view of the metal skeleton shown in FIG. 5

In the embodiment shown in FIGS. 4, 5 and 7, the skeleton 70 furthermore defines cooperating instrumentalities 80 for maintaining the plastic housing 40 and skeleton 70 in operable association relative to each other. As will be appreciated, the exact shape and design of the cooperating instrumentalities 80 for maintaining the plastic housing 40 and skeleton 70 in operable association relative to each other can take a myriad of designs and configuration without detracting or departing from the spirit and scope of this invention disclosure.

In the embodiment illustrated by way of example in FIGS. 4, 5 and 7, the metal skeleton 70 is preferably provided with a plurality or series of grooves or channels 82. Each groove or channel 82 preferably extends through and opens to each side of the skeleton 70. As such, and when the non-metal housing 40 is formed about the skeleton 70, plastic material flows into and through each groove or channel 82 in the skeleton 70 whereby maintaining the plastic housing 40 and skeleton 70 in operable association relative to each other.

Like the aesthetics of the side bearing housing design elected for exemplary purposes, the exact shape or form of the spring 100 can vary or be different from that illustrated without detracting or departing from either the spirit or scope of this invention disclosure. In the embodiment illustrated in FIG. 4, spring 100 is comprised of a formed and resiliently deformable thermoplastic elastomer member 110. The purpose of the spring 100 is to position the top plate 62 of the cap relative to the housing 40 and to develop a predetermined preload or suspension force thereby urging the plate 62 of cap 60 toward and into frictional sliding engagement with the underside 19 of the car body 12. The preload or suspension force on the cap or member 60 allows absorption of forces imparted to the side bearing assembly 30 when the car body 12 tends to roll, i.e., oscillate about a horizontal axis of car body 12 and furthermore inhibits hunting movements of the wheeled truck (FIG. 1) relative to the car body 12.

In the embodiment illustrated for exemplary purposes in FIG. 4, member 110 of spring 100 has a configuration suitable for accommodation between base 46 of the side bearing housing 40 and an underside of the plate 62 of cap or member 60. Member 110, illustrated by way of example in FIG. 4, preferably embodies the teachings set forth in coassigned U.S. Pat. No. 6,792,871 the applicable portions of which are incorporated herein by reference. In the illustrated embodiment, member 110 defines a generally centralized bore 112 opening to axially aligned ends of member 110. It should be appreciated, however, member 110 could also be solidly configured. Suffice it to say, the thermoplastic member 110 preferably has an elastic strain to plastic strain ratio of about 1.5 to 1. Coassigned U.S. Pat. No. 4,198,037 to D. G. Anderson, the applicable portions of which are incorporated hereby by reference, better describes the composition and methodology for forming member 110.

In the illustrated embodiment, a thermal insulator 120 is preferably arranged at one end of and is intended to operably protect the thermoplastic member 110 from the adverse affects of heat generated by the sliding frictional movements between the underside 19 of the railcar body 12 (FIG. 3) and the planar surface 62 on the side bearing cap 60 during movements of the railcar between locations. Suffice it to say, and in the illustrated embodiment, the thermal insulator 120 is operably carried at one end of the thermoplastic member 110 and is preferably of the type disclosed in coassigned U.S. Pat. Nos. 6,092,470; 6,892,999; and 7,044,061; the applicable portions of which are incorporated herein by reference.

In the embodiment illustrated for exemplary purposes in FIG. 4, the base 46 of the side bearing assembly 40 supports that end of the spring 100 opposite from the thermal insulator 120. Preferably, the skeleton 70 furthermore defines a spring guide or projection 78 centrally located on the base 74 of the skeleton 70. In the illustrated embodiment, the spring guide 78 fits within the bore or recess 112 defined by member 110 whereby operably locating at least the lower end of the spring 100 within the side bearing assembly housing 40. In the illustrated embodiment, the spring guide 78 defines a flat or stop 78' at a distal end thereof.

In the embodiment illustrated in FIG. 4, the cap 60 also includes a spring guide 66 generally concentrically disposed within the cavity 68 defined by the cap 60 and which generally aligns with the spring guide or projection 78 on the base 72 of skeleton 70 when housing 40 and cap 60 are arranged in operable combination relative to each other. Preferably, spring guide 68 defines a flat or stop 68' which, when housing 40 and cap 60 are arranged in operable combination relative to each other, is disposed in axially spaced but confronting relation relative to the stop 78 on the skeleton 70 of housing 70 to limit compression of the cap 60 relative to housing 40.

During travel of railcar 13, the wheeled truck naturally hunts or yaws about a vertical axis of the truck, thus, creating frictional sliding or oscillating movements at and along the interface of the top plate 62 of cap 60 and the underside of the car body 12 thereby creating significant and even excessive heat. When the heat at the interface of the side bearing assembly 30 and the underside 19 of the car body 12 exceeds the heat deflective temperature of the thermoplastic member 110, deterioration, deformation and even melting of the thermoplastic member 110 can occur thus adversely affecting predetermined preload characteristics provided by the spring 100.

Accordingly, the side bearing assembly 30 is preferably configured to promote dissipation of heat away from the elastomeric spring 100 thereby prolonging the usefulness of the side bearing assembly 30. More specifically, and as shown in FIGS. 3 and 4, the wall structure 44 of the housing 40 preferably defines a pair of openings 45, 45' disposed to opposed sides of the centerline 47 of the side bearing assembly 30 toward the bottom of the housing 40 adjacent to an intersection of the wall structure 44 and base 46. The openings 45 extend from an interior of cavity 48 (FIG. 4) to the exterior of the housing 40.

In the illustrated embodiment, the radial spacing between the upstanding wall structures 77 and 77' of the metal skeleton 70 are arranged relative to the openings 45, 45' in the side bearing housing 40 such that the wall structures 77, 77' do not obstruct or otherwise interfere with venting of heat from an interior of the spring cavity 69 and through the openings 45, 45' in the housing 44. Of course, rather than being radially spaced relative to each other, the wall structure 76 of the metal skeleton 70 could otherwise be designed with suitable openings disposed relative to the openings 45, 45' in the side bearing housing 40 to readily permit venting of heat from an interior of the cavity 48 and through the openings 45, 45' in the housing 44 without detracting or departing from the spirit and scope of this invention disclosure.

To furthermore promote the dissipation of heat from the side bearing assembly 30, cap 60 is preferably configured to vent heat away from the spring 100. As shown in FIG. 2, cap 60 is preferably configured with a pair of openings 67 and 67'; arranged proximate to the intersection of the top plate 62 and wall structure 64. At least a portion of each opening 67, 67' is defined by the wall structure 64 of cap 60 whereby allowing the openings 67, 67' to remain unobstructed by the underside 19 of the railcar body 12 during operation of the railcar side bearing assembly 30. In a preferred form, the openings 67, 67' are disposed to opposed sides of the centerline 47 of the side bearing assembly 30. In the illustrated embodiment, the openings 67, 67' are generally aligned along a line extending generally perpendicular or normal to the longitudinal axis 55 of the side bearing assembly 30 (FIG. 2). In the illustrated embodiment, the openings 45, 45' in the housing 40 communicate with and define an air passage with the openings 69, 69' in the top cap 60 whereby promoting the dissipation of heat from the spring cavity 69. As will be appreciated, the openings 45, 45' along with 67, 67' provide a particular advantage when a thermoplastic spring is used to resiliently urge the cap 60 against and into frictional sliding contact with an underside 15 of the railcar body 12 (FIG. 2).

Returning to FIG. 2, the side bearing housing 40 and cap 60 furthermore preferably define cooperating instrumentalities, generally identified by reference numeral 130. The purpose of the cooperating instrumentalities 130 is to guide cap 60 for vertical reciprocatory movements relative to the housing 40 and for maintaining a predetermined relation between cap 60 and the side bearing housing 40. As will be appreciated, the cooperating instrumentalities 130 can take many forms and shapes for accomplishing the desired ends or purposes without detracting or departing from the spirit and scope of this invention disclosure.

In the embodiment shown in FIG. 2, the interior surface 49 of the side bearing housing 40 preferably defines a pair of vertically extending keyways or recesses 132 which, in the illustrated embodiment, are positioned in diametrically opposed relation from each other. Each keyway or recess 132 extends generally vertically along the side bearing housing 40 for a vertical distance which is sufficient to accommodate and guide vertical reciprocatory movements of the side bearing cap 60 during operation of the side bearing assembly 30.

Preferably, in the embodiment illustrated in FIG. 2, the keyways 132 are formed integral with the housing 40 and are disposed in generally orthogonal relation with the longitudinal axis 55. Moreover, and in a preferred form, cap 60 defines a pair of projections or keys 136 which are configured to mate with and slide along the keyway or recess 132 defined by the side bearing housing 40 whereby guiding cap or member 60 for vertical reciprocatory movements relative to the housing 40 while maintaining a predetermined relation between the housing 40 and cap 60 during operation of the side bearing assembly 30.

Figure 9:
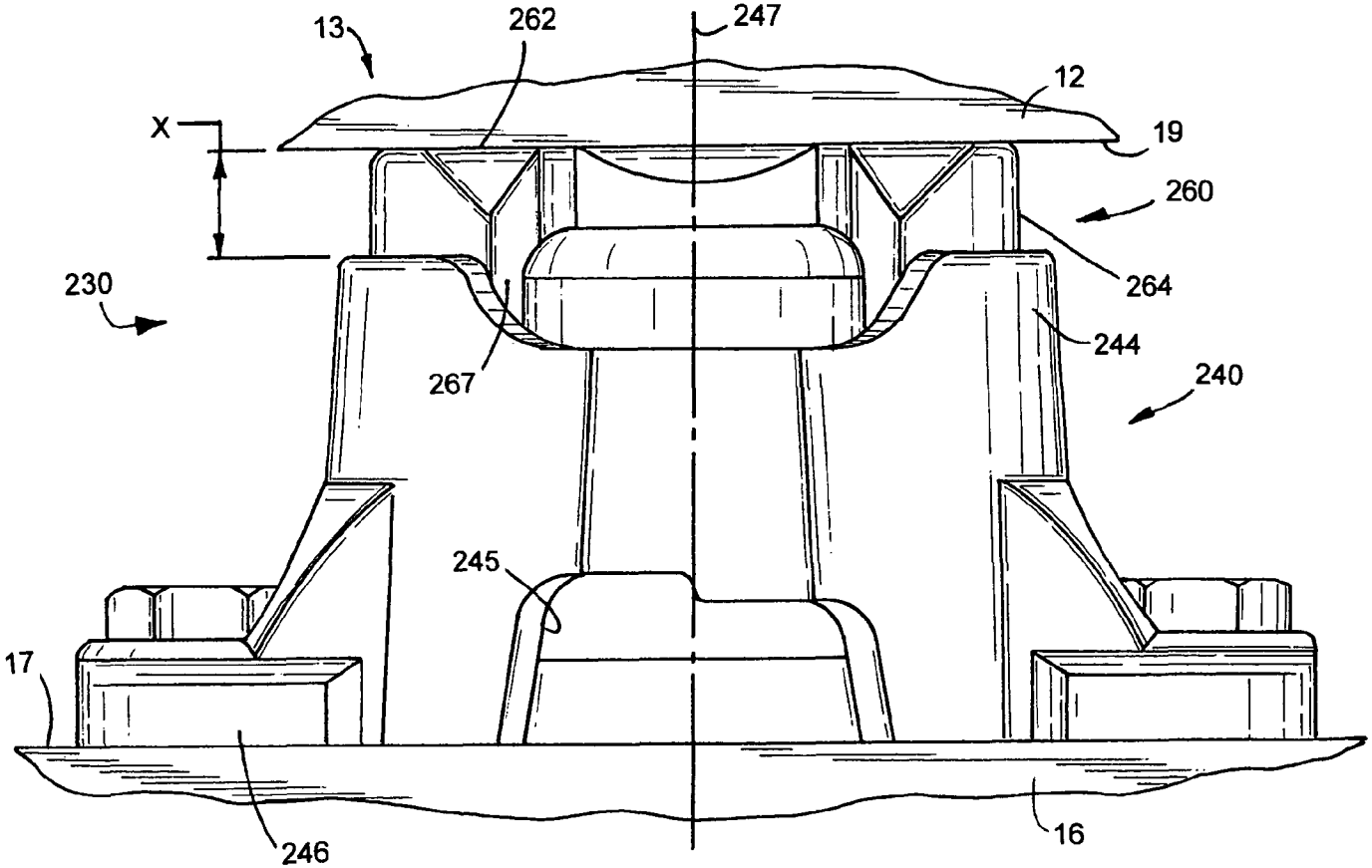
FIG. 9 is an elevational view of the side bearing assembly shown in FIG. 8.
Figure 10:
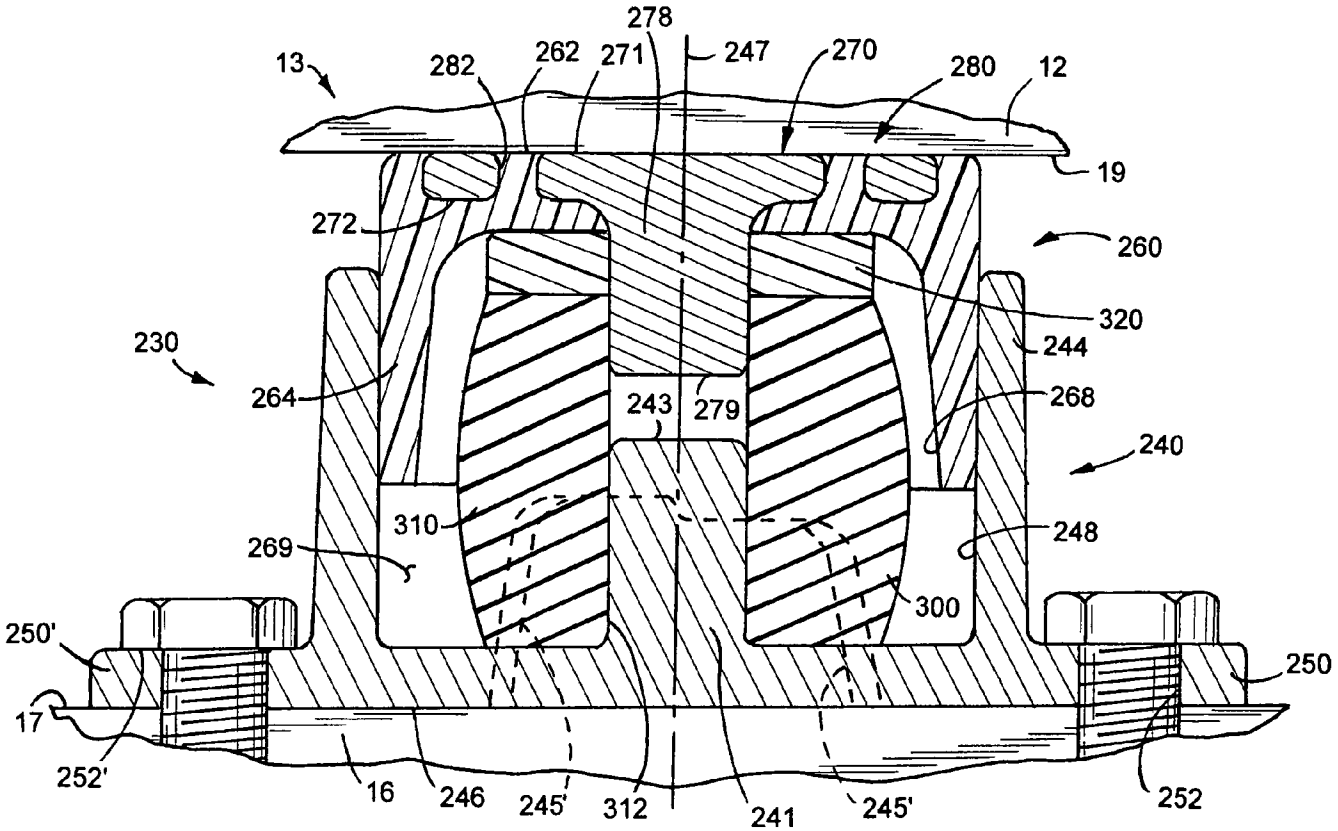
FIG. 10 is a longitudinal sectional view of the side bearing assembly taken along line 10-10 of FIG. 8.

FIGS. 8 through 10 illustrate an alternative form for the constant contact side bearing assembly of the present invention. This alternative form of the constant contact side bearing assembly is designated generally by reference numeral 230. The elements of this alternative form of side bearing assembly that are functionally analogous to those components discussed above regarding side bearing assembly 30 are designated by reference numerals identical to those listed above with the exception this embodiment uses reference numerals in the 200 series.

Side bearing assembly 230 includes a housing or cage 240, a cap 260 arranged for generally telescoping or vertical reciprocatory movements relative to the housing 240, and a spring 300 (FIG. 10). In this embodiment, the housing 240 is preferably formed of a strong and wear resistant metal material such as steel or the like.

In this embodiment, housing 240 includes wall structure 244 extending upwardly from a base 246 to define an axis 247 for side bearing assembly 230. The wall structure 244 extends upwardly from base 246 for a predetermined distance. The wall structure 244 of the side bearing housing 40 defines an open-top cavity or internal void 248. The housing base 246 includes radial flanges 250, 250'. As shown in FIG. 10, the mounting flanges 250, 250' define bores or apertures 252, 252', respectively, for allowing a suitable fastener to pass therethrough whereby permitting the housing 240 to be fastened to the upper surface 17 of bolster 16. Preferably, the bores or apertures 252, 252' are aligned relative to each other along a longitudinal axis 254 such that, when the side bearing assembly 230 is fastened to the bolster 16, axis 245 extends generally parallel to the longitudinal axis 18 of the railcar body 12 (FIG. 1).

Cap 260 is arranged in operable combination with and for vertical reciprocatory movements relative to housing 240 In this embodiment, however, and to enhance the vertical reciprocity of cap 260 relative to the housing 240, cap 260 is formed from a non-metal, high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto. Besides being less weight than steel, forming the cap 260 from such non-metal, high performance plastic has also shown to offer lower wear rates between the sliding contact surfaces as compared to steel which, in turn, increases the expectant life of the side bearing assembly 230.

As shown in FIG. 10, cap 260 is at least partially positioned within housing 240 for generally reciprocatory movements and includes an upper generally flat surface 262. When the side bearing assembly 230 is secured to the bolster 16, the generally flat surface 262 of member 260 is disposed above a terminal end of the wall structure 244 of the side bearing housing 240 for a predetermined distance. In the example shown, the normal distance between surface 262 of member 260 and the top edge of the wall structure 244, indicated by the distance "X" in FIG. 9, is determinative of the permissible compressive movement of the side bearing assembly 230 and such that after the underside 19 of the railcar body 12 contacts an upper edge of the housing structure 244, the side bearing assembly 230 functions as a solid unit and will prevent further rocking and relative movements between the bolster and the railcar body 12.

Figure 11:
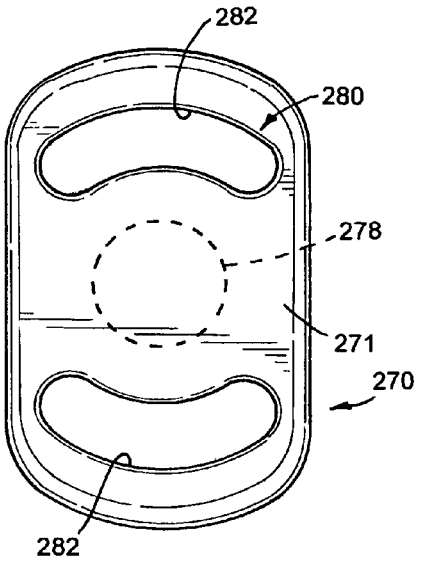
FIG. 11 is a top plan view of one form of insert forming part of a cap used in operable combination with the side bearing assembly shown in FIG. 8.
Figure 12:
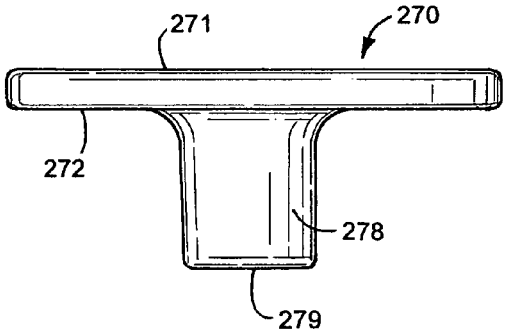
FIG. 12 is a side elevational view of the insert shown in FIG. 11.
Figure 13:
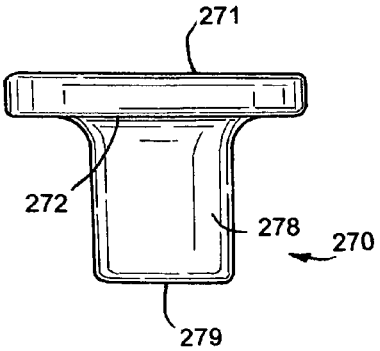
FIG. 13 is an end view of the insert shown in FIG. 11.

As shown in FIG. 10, cap 260 furthermore includes wall structure 264 depending from and preferably formed integral with the generally flat or planar surface 262 of cap 260 to define an open-bottom cavity 268. Preferably, at least an axial section of the wall structure 264 of cap 260 has a generally cylindrical configuration. As shown in FIG. 11, an outer surface 268' on the wall structure 264 of cap 260 complements an inner surface 249' defined by the wall structure 244 of the side bearing housing 240 The open-top wall structure 244 of the side bearing housing 240 and the open-bottom wall structure 268 of cap 260 operably combine relative to each other to surround the spring 300 and define a void 269 wherein spring 300 is accommodated. As will be appreciated, if the wall structure 244 of housing 240 is designed with other than a generally round cross-sectional configuration, the cross-sectional configuration of the wall structure 264 of cap 260 would similarly change and vice versa.

In the embodiment shown in FIGS. 8 and 10, the cap 260 furthermore includes an insert 270 that is maintained in operable association with and preferably generally centered on the upper generally flat surface 262 cap 260. The insert 270 is preferably formed from a metal material selected from the class of: steel and austempered ductile iron. As shown in FIG. 10, the insert 270 is arranged in operable association with cap 260 so as to slidably interact and contact with the underside 19 of the car body 12. In the embodiment illustrated by way of example, the insert 270 has a width of about 2 inches and a length of about 3.5 inches.

In the embodiment illustrated by way of example in FIG. 10, the insert 270 is furthermore preferably provided with an elongated upper and generally planar or flat surface or side 271 adapted to slidably and frictionally engage with an underside 19 of the railcar body 12 and a lower generally planar or flat surface or side 272. In one form, the surfaces 271 and 272 are separated by about 0.375 inches. Suffice it to say, the insert 270 is engineered and designed whereby allowing the side bearing assembly 230 to establish a coefficient of friction ranging between about 0.4 and about 0.9 with the railcar 13 during operation of the constant contact side bearing assembly 230 so as to limit hunting movements and oscillation of the wheeled truck assembly 10 as the railcar moves over the tracks.

In the embodiment shown in FIGS. 8, 10 and 11, cap 260 and insert 270 define cooperating instrumentalities 280 for maintaining the cap 260 and insert 270 in operable association relative to each other. As will be appreciated, the exact shape and design of the cooperating instrumentalities 280 for maintaining the cap 260 and insert 270 in operable association relative to each other can take a myriad of designs and configuration without detracting or departing from the spirit and scope of this invention disclosure.

In the embodiment illustrated in FIGS. 8, 10 and 11, the cooperating instrumentalities 280 preferably includes a plurality or series of arcuate equally spaced grooves or channels 282. Each groove or channel 282 preferably opens to both sides or surfaces 271 and 272 on the insert 270. As such, and when the non-metal cap 260 is formed, plastic material comprising the cap 260 can flow into each groove or channel 282 whereby maintaining the top cap 260 and insert 270 in operable association relative to each other.

Like side bearing assembly 30 discussed above, in the embodiment of the side bearing assembly 230 illustrated in FIG. 10, spring 300 includes an elastomeric member 310 and is arranged in operable combination with housing 240 and cap 260 for absorbing, dissipating and returning energy imparted to the side bearing assembly 230. Preferably, spring 300 is of the type described above regarding spring 100 and incorporated herein by reference. Spring 300 is arranged and accommodated within cavity 269 defined by housing 240 and cap 260. Moreover, spring 300 can include a thermal insulator 320 of the type disclosed above and incorporated herein by reference. Like the configuration of the side bearing assembly, the exact shape or form of the spring 300 can vary or be different from that illustrated for exemplary purposes without detracting or departing from either the spirit or scope of this invention disclosure.

In the illustrated embodiment, member 310 of spring 300 has a configuration suitable for accommodation between base 246 of the side bearing housing 240 and an underside of the plate 262 of cap or member 260. In the illustrated embodiment, member 310 defines a generally centralized bore 312 opening to axially aligned ends of member 310. Suffice it to say, the thermoplastic member 310 preferably has an elastic strain to plastic strain ratio of about 1.5 to 1.

In the embodiment illustrated in FIG. 10, the base 246 of the side bearing assembly 240 supports that end of the spring 300 opposite from the thermal insulator 320. Preferably, the base 246 of side bearing housing 240 defines a spring guide or projection 241 centrally located on the side bearing housing base 244. In the illustrated embodiment, the spring guide 241 fits within the bore or recess 312 defined by the elastomeric member 310 whereby operably locating at least the lower end of the spring 300 within the side bearing assembly housing 340. In the illustrated embodiment, the spring guide 241 defines a flat or stop 243 at a distal end thereof.

In the embodiment illustrated in FIGS. 10 through 13, insert 270 also includes a spring guide 278 which generally aligns with the spring guide or projection 241 on the base 246 of side bearing housing 240 when the housing 240 and cap 260 are arranged in operable combination relative to each other. Preferably, the spring guide 278 carried by insert 270 defines a flat or stop 279 which, when housing 240 and cap 260 are arranged in operable combination relative to each other, is disposed in axially spaced but confronting relation relative to the stop 243 on the side bearing housing 240 to limit compression of the cap 60 relative to housing 40.

Side bearing assembly 230 is preferably configured to promote dissipation of heat away from the elastomeric spring 300 thereby prolonging the usefulness of the side bearing assembly 230. As with the above described side bearing housing 40, the wall structure 244 of the housing 240 is preferably configured to define a pair of openings 245, 245' arranged to opposed sides of the side bearing assembly 30 toward the bottom of the housing 244 adjacent to an intersection of the wall structure 244 and the base 246 for venting heat from the spring cavity 269.

Returning to FIG. 8, and to furthermore promote the dissipation of heat away from the spring 300, cap 260 is preferably configured to vent heat away from the spring 400. The plastic cap 260 is preferably configured with a pair of openings 267 and 267'; arranged proximate to the intersection of the top plate 262 and wall structure 264. At least a portion of each opening 267, 267' is defined by the wall structure 264 of cap 60 whereby allowing the openings 267, 267' to remain unobstructed by the underside 19 of the railcar body 12 during operation of the railcar side bearing assembly 30. Suffice it to say, the openings 267, 267' in cap 260 are substantially similar to the openings 67, 67' in cap 60. Preferably, the openings 245, 245' in the side bearing housing 240 communicate and define an air passage with the openings 267, 267' in the cap 60 whereby promoting the dissipation of heat from spring cavity 269.

The side bearing housing 240 and cap 260 furthermore preferably define cooperating instrumentalities, generally identified by reference numeral 330. The purpose of the cooperating instrumentalities 330 is to guide cap 260 for vertical reciprocatory movements relative to the housing 240 and for maintaining a predetermined relation between cap 60 and the side bearing housing 240. The cooperating instrumentalities 330 can take many forms and shapes for accomplishing the desired ends or purposes without detracting or departing from the spirit and scope of this invention disclosure.

In the embodiment shown in FIG. 8, an interior surface 249 of the side bearing housing 240 preferably defines a pair of vertically extending keyways or recesses 332 which, in the illustrated embodiment, are positioned in diametrically opposed relation from each other. Each keyway or recess 332 extends generally vertically along the side bearing housing 240 for a vertical distance which is sufficient to accommodate and guide vertical reciprocatory movements of the side bearing cap 260 during operation of the side bearing assembly 230.

Preferably, in the embodiment illustrated in FIG. 8, the keyways 332 are formed integral with the housing 240 and are disposed in generally orthogonal relation with the longitudinal axis 254. Moreover, and in a preferred form, the plastic cap 260 defines a pair of radial projections or keys 336 which are configured to mate with and slide along the keyway or recess 332 defined by the side bearing housing 240 whereby guiding cap or member 260 for vertical reciprocatory movements relative to the housing 240 while maintaining a predetermined relation between the housing 240 and cap 260 during operation of the side bearing assembly 230.

Figure 14:
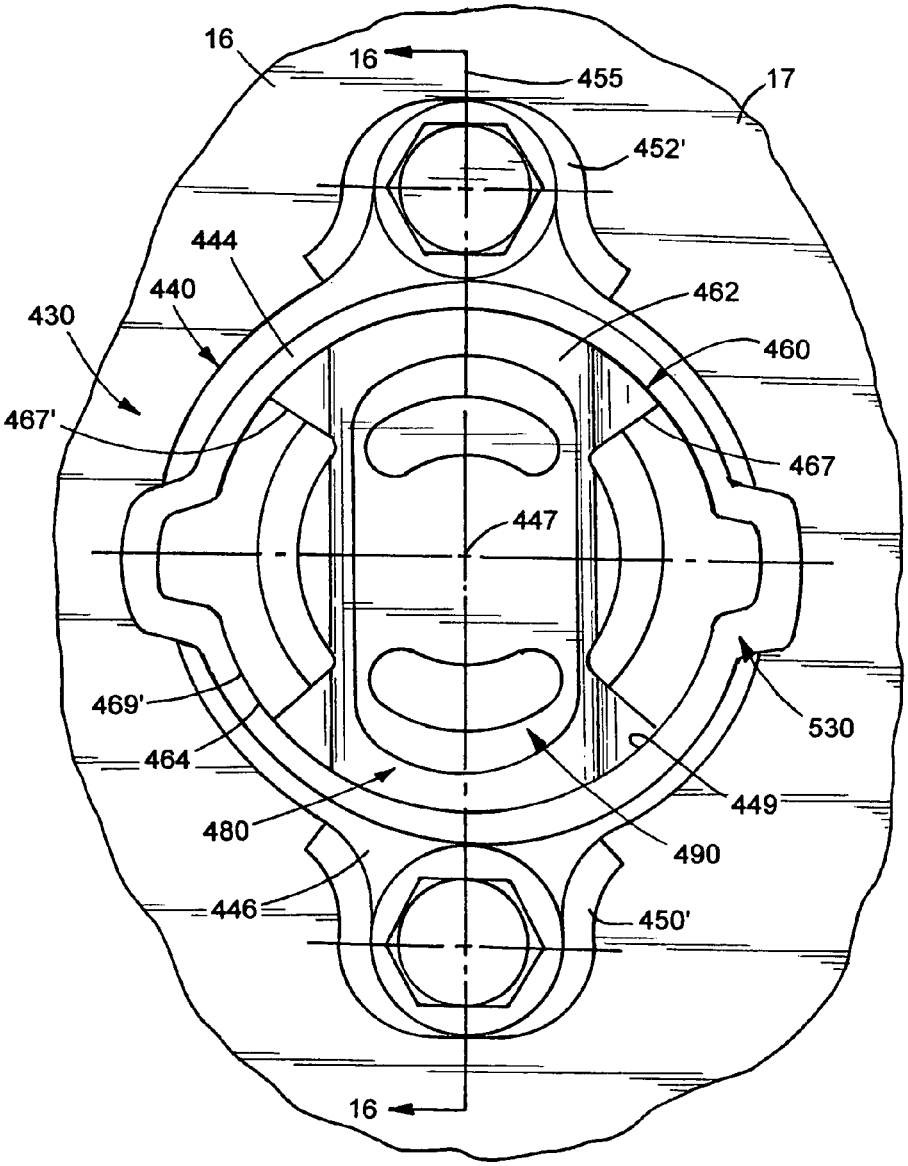
FIG. 14 is an enlarged top plan view of another embodiment of constant contact side bearing assembly embodying principals and teachings of this invention disclosure.
Figure 15:
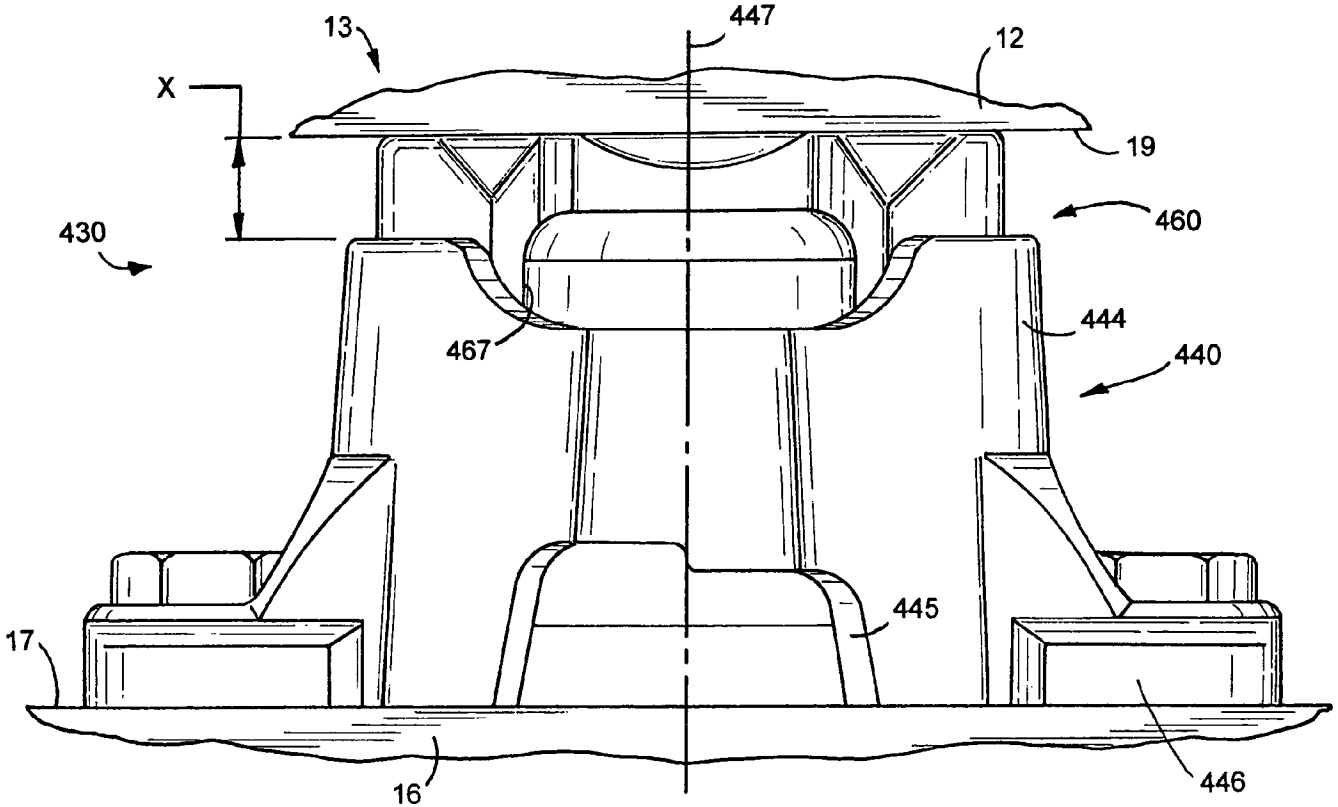
FIG. 15 is an elevational view of the side bearing assembly shown in FIG. 14.
Figure 16:
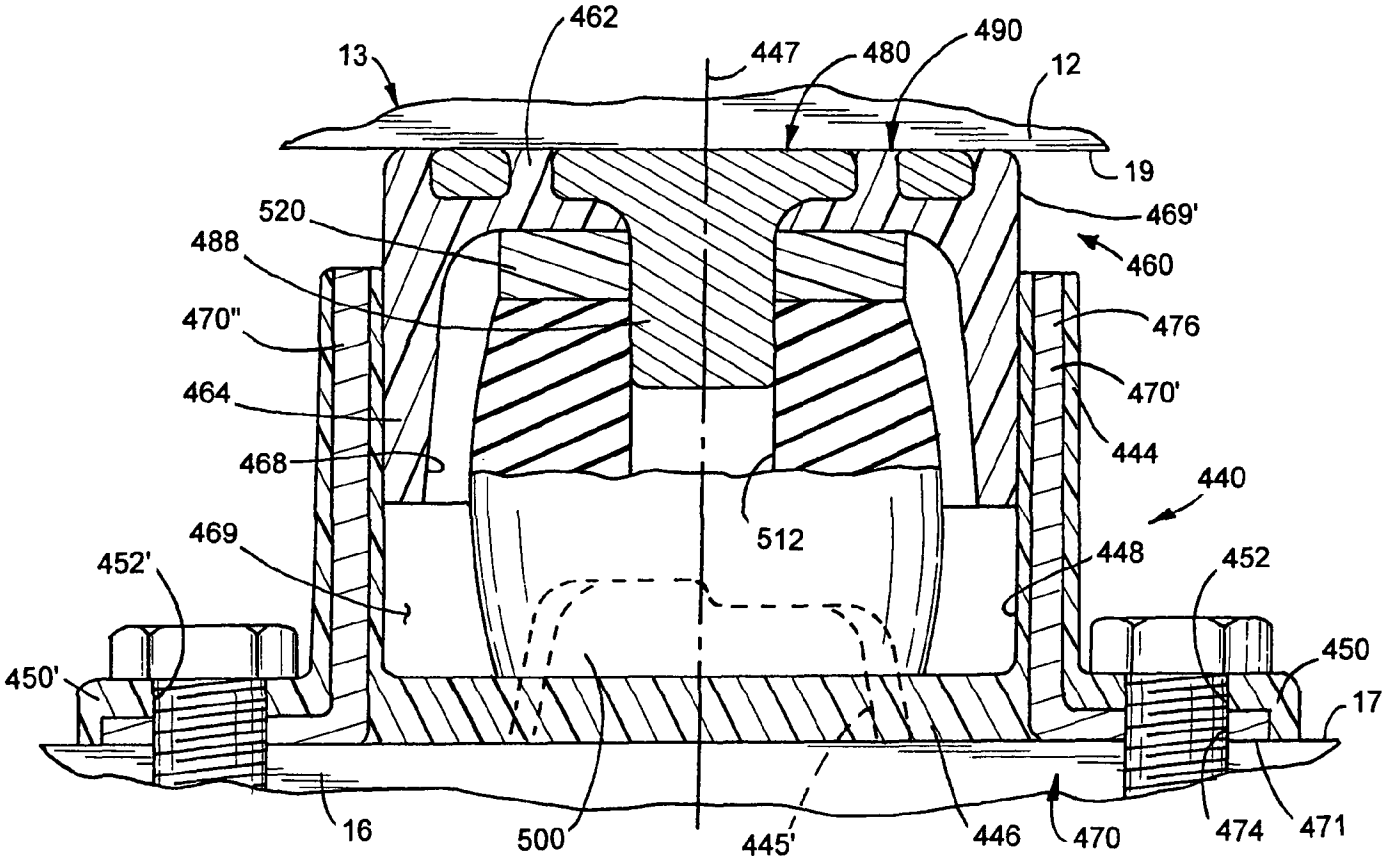
FIG. 16 is a longitudinal sectional view of the side bearing assembly taken along line 16-16 of FIG. 14.

FIGS. 14 through 16 illustrate another alternative embodiment for the constant contact side bearing assembly of the present invention. The alternative form of constant contact side bearing assembly shown in FIGS. 14 through 16 is designated generally by reference numeral 430. The elements of this alternative form of side bearing assembly that are functionally analogous to those components discussed above regarding side bearing assembly 30 are designated by reference numerals identical to those listed above with the exception this embodiment uses reference numerals in the 400 series.

Side bearing assembly 430 includes a housing or cage 440, a cap 460 arranged for generally telescoping or vertical reciprocatory movements relative to the housing 440, and a spring 500 (FIG. 16). In this embodiment, the housing 440 includes wall structure 444 having an interior surface 449 and extending upwardly from a base 446 to define an axis 447 for the side bearing assembly 430. The housing wall structure 444 extends upwardly from the base 446 for a predetermined distance. The wall structure 444 of the side bearing housing 440 defines an open-top cavity or internal void 448. In the illustrated embodiment, at least an axial section of the housing wall structure 444 has a generally cylindrical cross-sectional configuration.

The housing base 446 is configured for suitable attachment to the upper surface 17 of the railcar bolster 16 as through any suitable means, i.e. threaded bolts or the like. In the illustrated embodiment, housing base 446 includes a pair of mounting flanges 450 and 450' radially extending outwardly in opposed directions away from the side bearing assembly axis 447. Each mounting flange 450, 450' defines a bore or aperture 452, 452' (FIG. 14), respectively, for allowing a suitable fastener to extend therethrough whereby permitting the housing 440 to be fastened to the upper surface 17 of the bolster 16. Preferably, the bores or apertures 452, 452' are aligned relative to each other along a longitudinal axis 455 (FIG. 1) such that, when housing 440 is secured to the bolster 16, axis 455 extends generally parallel to the longitudinal axis 18 of car body 12 (FIG. 1).

According to this aspect of this invention disclosure, and as illustrated in FIG. 14, the housing 440 is formed from a high performance plastic material to enhance vertical reciprocity of the cap 460 relative to the housing 440. In this embodiment, housing 440 is formed from a non-metal, high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto. Besides being less weight than steel, forming the housing 440 from such non-metal, high performance plastic material has also shown lower wear rates between the sliding surfaces or contact areas with cap 460 which, in turn, increases the expectant life of the side bearing assembly 430.

To add strength and rigidity thereto, a metal skeleton 470 is arranged in operable combination with and forms and integral part of housing 440. In the embodiment shown by way of example in FIG. 14, the skeleton 470 includes at least two separate and longitudinally spaced parts or pieces 470' and 470".

Figure 17:
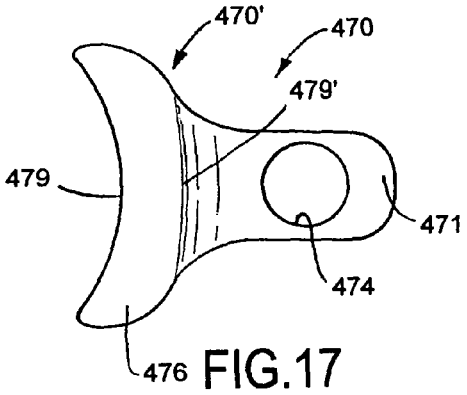
FIG. 17 is an side elevational view of one form of a part of used in operable combination with the side bearing assembly illustrated in FIG. 16.
Figure 18:
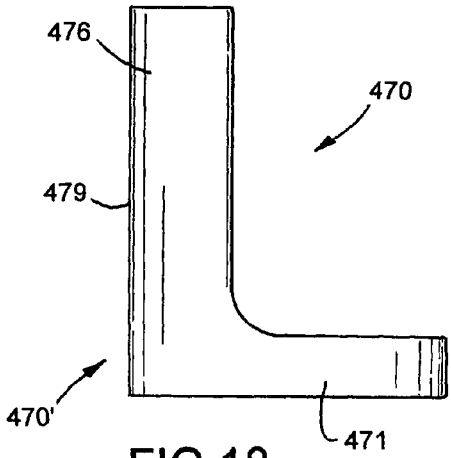
FIG. 18 is a top plan view of the part illustrated in FIG. 17.
Figure 19:
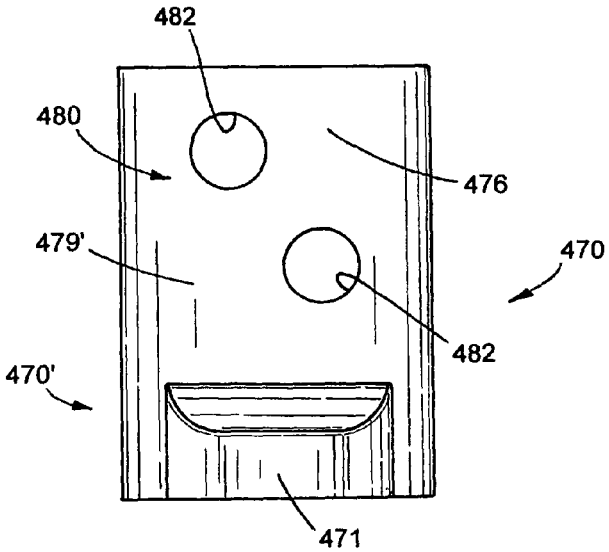
FIG. 19 is an end elevation of the part illustrated in FIG. 17.

Preferably, the pieces 470' and 470" are substantially identical relative to each other to reduce manufacturing costs of the side bearing assembly 430. Since the pieces 470' and 470' comprising the skeleton 470 are substantially identical, only part 470' will be described in detail. In this embodiment, each skeletal piece comprising skeleton 470 is preferably formed from a strong and rigid metal material selected from the class of: steel and austempered ductile iron whereby enabling the wall structure 444 of housing 440 to absorb the relatively high impact loads and forces directed thereagainst during operation of the side bearing assembly 430. As illustrated in FIGS. 17, 18 and 19, skeletal piece 470' preferably has a generally L-shaped configuration and includes a base 471 defining a bore or aperture 474 toward one end thereof for allowing a suitable fastener to extend therethrough whereby permitting the housing 440 (FIG. 18) to be fastened to the upper surface 17 of the bolster 16. Notably, the bores or apertures 474 in the skeletal pieces 470', 470" are longitudinally aligned relative along axis 455 and relative to each other when the housing 440 is formed so as to facilitate securement of the side bearing assembly 430 to the to the upper surface 17 of the bolster 16. Moreover, and when the plastic cap 460 is molded or otherwise formed about the skeletal pieces 470', 470", the longitudinal spacing between the bores or openings 474 in the skeletal pieces 470', 470" is equal to the longitudinal spacing between the bores 452, 452' in the housing 440.

Each skeletal piece furthermore includes generally vertical wall structure 476 extending upwardly from the base 471 and embedded within and adding strength and rigidity to the plastic wall structure 444 of housing 440. In the embodiment shown in FIG. 16, the wall structure 476 of each part of skeleton 470 preferably extends upwardly from base 472 and terminates at or adjacent to a terminal end of the wall structure 444 of housing 440. Preferably, the wall structure 476 of each skeletal piece is formed integral with the base 471. In one form, the upstanding wall structure 476 of each skeletal piece 470', 471" will be arranged concentrically relative to the wall structure 44 of housing 440. In this embodiment of the invention disclosure, each side or surface preferably has a generally arcuate or radiused configuration, in plan, which complements the configuration of the wall structure 444 of the side bearing housing 440. The skeletal pieces or parts 470', 470"each have an inner surface 479 and an outer surface 479. Suffice it to say, in this embodiment of the invention disclosure, the outer surface 469' of the metal cap 460 is separated from the interior surface 449 of the housing 440 as well as the inner surface 479 of the each skeletal piece or part 470', 470" by high performance plastic material to enhance vertical reciprocity of the cap 460 relative to the housing 440.

Each skeletal piece of skeleton 470 also defines cooperating instrumentalities 480 for maintaining the plastic housing 440 and skeleton 470 in operable association relative to each other. As will be appreciated, the exact shape and design of the cooperating instrumentalities 480 for maintaining the plastic housing 440 and skeleton 470 in operable association relative to each other can take a myriad of designs and configuration without detracting or departing from the spirit and scope of this invention disclosure.

In the embodiment illustrated by way of example in FIG. 19, the wall structure 476 of each skeletal piece of skeleton 470 is preferably provided with a plurality or series of openings 482. Each opening 482 preferably opens to each generally vertical side 479, 479' of the wall structure 476. As such, and when the non-metal housing 40 is formed about the pieces or parts comprising skeleton 470, plastic material flows into and through each opening 482 whereby maintaining the plastic housing 440 and the pieces or parts 470', 470 of the metal skeleton 470 in operable association relative to each other. Of course, it will be appreciated, more than two parts each having a different design from each other could alternatively be used to form the metal skeleton 470 without detracting or departing from the spirit and scope of this invention disclosure.

Returning to FIG. 16, the cap 460 is arranged in operable combination with and for vertical reciprocal movement relative to housing 440. Like that embodiment of the invention disclosure discussed above, and to enhance the vertical reciprocity of cap 460 relative to the housing 440, cap 460 is preferably formed from a non-metal, high performance plastic material of the type sold by DuPont™ under the tradename Zytel® under Model Nos. 75LG50HSL BK031, 70G33HS1L BK031, ST801AHS BK010, and HTNFE8200 BK431 and equivalents thereto.

Suffice it to say, the plastic or non-metal cap 460 embodies many of the same features discussed above regarding cap 260. The plastic cap 460 is positioned at least partially within the housing 440 for generally vertical movements and includes an upper generally flat surface 462. When the side bearing assembly 430 is secured to the bolster 16, the generally planar surface 462 of the side bearing assembly 430 is disposed above a terminal end of the upstanding wall structure 444 of the side bearing housing 440 for a predetermined distance.

As shown in FIG. 16, cap 460 includes wall structure 464 depending from and preferably formed integral with the generally flat or planar surface 462 to define an open-bottom cavity 468. Preferably, at least an axial section of the wall structure 464 of cap 460 has a generally cylindrical configuration. As shown in FIG. 14, an outer surface on the wall structure 464 of cap 460 complements an inner surface defined by the wall structure 444 of the side bearing housing 440 The open-top wall structure 444 of the side bearing housing 240 and the open-bottom wall structure 468 of cap 460 operably combine relative to each other to surround the spring 500 and define a void 469 wherein spring 500 is accommodated. As will be appreciated, if the wall structure 444 of housing 440 is designed with other than a generally round cross-sectional configuration, the cross-sectional configuration of the wall structure 464 of cap 460 would similarly change and vice versa.

Moreover, the plastic cap 460 includes an insert 480 that is maintained in operable association with and preferably generally centered on the upper generally flat surface 462 of cap 460. Insert 480 is preferably formed from a metal material selected from the class of: steel and austempered ductile iron. As shown in FIG. 16, insert 480 is arranged in operable association with cap 460 so as to slidably interact and contact with the underside 19 of the car body 12. In the embodiment illustrated by way of example, the insert 470 is engineered and designed whereby allowing the side bearing assembly 430 to establish a coefficient of friction ranging between about 0.4 and about 0.9 with the railcar 13 during operation of the constant contact side bearing assembly 430 so as to limit hunting movements and oscillation of the wheeled truck assembly 10 as the railcar moves over the tracks.

In the embodiments shown in FIGS. 14 and 16, cap 460 and insert 480 preferably define cooperating instrumentalities 490 for maintaining cap 460 and insert 480 in operable association relative to each other. The exact shape and design of the cooperating instrumentalities 490 for maintaining cap 460 and insert 480 in operable association relative to each other are preferably similar to the cooperating instrumentalities 290 discussed above but can take a myriad of other designs without detracting or departing from the spirit and scope of this invention disclosure.

Like side bearing assembly 30 discussed above, in the embodiment of the side bearing assembly 430 illustrated in FIG. 16, spring 500 is arranged in operable combination with housing 440 and cap 460 for absorbing, dissipating and returning energy imparted to the side bearing assembly 430. The spring 500 is preferably of the type described above regarding spring 100 and incorporated herein by reference. As shown, spring 500 is arranged and accommodated within the cavity 469 defined by housing 440 and cap 460. Moreover, the spring 500 can include a thermal insulator 520 of the type disclosed above and incorporated herein by reference. Like the configuration of the side bearing assembly, the exact shape or form of the spring 500 can vary or be different from that illustrated for exemplary purposes without detracting or departing from either the spirit or scope of this invention disclosure.

In the illustrated embodiment, member 510 of spring 500 has a configuration suitable for accommodation between base 446 of the side bearing housing 440 and an underside of the plate 462 of cap or member 460. In the illustrated embodiment, member 510 defines a generally centralized bore 512 opening to at least one end of member 510. Suffice it to say, the thermoplastic member 510 preferably has an elastic strain to plastic strain ratio of about 1.5 to 1.

In the embodiment illustrated for exemplary purposes in FIG. 16, the base 446 of the side bearing assembly 440 supports that end of the spring 500 opposite from the thermal insulator 520. In the embodiment illustrated in FIG. 16, the insert 480 associated with cap 460 also includes a spring guide 478 depending from the underside of the top plate 462 of the cap 460. Preferably, the spring guide 488 carried by insert 480 is preferably designed to fit endwise and within the bore 512 in the spring member 510 whereby positively positioning the spring 500 with the cavity 469 defined by the side bearing assembly 430.

Moreover, the side bearing assembly 430 is preferably configured to promote dissipation of heat away from the elastomeric spring 500 thereby prolonging the usefulness of the side bearing assembly 230. As with the above described side bearing housing 40, the wall structure 444 of the housing 440 preferably defines a pair of openings 445, 445' (FIGS. 15 and 16, respectively) disposed to opposed sides of the side bearing assembly 430 toward the bottom of the housing 444 adjacent to an intersection of the wall structure 444 and the base 446 for venting heat from the spring cavity 469.

Returning to FIG. 14, and to furthermore promote the dissipation of heat away from the spring 500, cap 460 is preferably configured to vent heat away from the spring 500. The plastic cap 460 is preferably configured with a pair of openings 467 and 467'; arranged proximate to the intersection of the top plate 462 and wall structure 464. At least a portion of each opening 467, 467' is defined by wall structure 464 of the cap 460 whereby allowing the openings 467, 467' to remain unobstructed by the underside 19 of the railcar body 12 during operation of the railcar side bearing assembly 430. Suffice it to say, the openings 467, 467' in cap 260 are substantially similar to the openings 67, 67' in cap 60. Preferably, the openings 445, 445' in the housing 440 communicate and define an air passage with the openings 467, 467' in the cap 60 whereby promoting the dissipation of heat from cavity 269.

The side bearing housing 440 and cap 460 furthermore preferably define cooperating instrumentalities, generally identified by reference numeral 530. The purpose of the cooperating instrumentalities 530 is to guide cap 460 for vertical reciprocatory movements relative to the housing 440 and for maintaining a predetermined relation between cap 60 and the side bearing housing 440. The cooperating instrumentalities 530 can take many forms and shapes for accomplishing the desired ends or purposes without detracting or departing from the spirit and scope of this invention disclosure. In the illustrated embodiment, the cooperating instrumentalities 530 are substantially similar to the instrumentalities 330 discussed above and incorporated herein by reference.

Regardless of the constant contact side bearing design, an important aspect of this invention disclosure relates to the ability to provide a non-metal material, preferably in the form of a high performance plastic material between the sliding surfaces on the side bearing housing and cap. This invention disclosure furthermore contemplates using a metal insert or skeleton in operable combination with that side bearing member formed from such non-metal, high performance plastic material whereby enabling the non-plastic member with sufficient strength and stiffness to withstand the relative high impact loads and forces directed against it during operation of the side bearing assembly. Moreover, and when such metal insert is used in operable combination with a plastic top cap design for the side bearing assembly, such construction allows the constant contact side bearing assembly to establish a coefficient of friction ranging between about 0.4 and about 0.9 with the railcar 13 during operation of the constant contact side bearing assembly so as to limit hunting movements and oscillation of the wheeled truck assembly as the railcar moves over the tracks.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

The invention claimed is:

1. A railroad car constant contact side bearing assembly, comprising:

a housing including upstanding wall structure defining an axis for said side bearing assembly;

a non-metallic cap arranged for generally coaxial movement relative to said housing, with said cap having a generally flat upper surface and wall structure depending from said generally flat upper surface, with the wall structure of said cap combining with the wall structure of said housing to guide said cap for generally vertical reciprocatory movement during operation of said side bearing assembly; and with the generally flat upper surface on said cap extending beyond the wall structure of said housing;

a spring accommodated within a cavity operably defined by the wall structure of said housing and the wall structure of said cap;

a metallic insert maintained in operable association with the generally flat surface on said cap to slidably contact with an underside of said railcar whereby allowing said side bearing assembly to establish a coefficient of friction ranging between about 0.4 and about 0.9 with the railcar during operation of said constant contact side bearing assembly.

2. The railroad car constant contact side bearing assembly according to claim 1 wherein, the insert maintained in operable association with said cap is formed from a metal material selected from the class of: steel and austempered ductile iron.

3. The railroad car constant contact side bearing assembly according to claim 1 wherein, said housing and said cap define cooperating instrumentalities for guiding said cap for vertical reciprocatory movements relative to said housing and for maintaining a predetermined relation between said cap and said housing.

4. The railroad car constant contact side bearing assembly according to claim 1 wherein, said spring includes an elastomeric member having first and second axially aligned ends.

5. The railroad car constant contact side bearing assembly according to claim 1 wherein, said housing includes a base with generally horizontal flange portions extending in opposite directions and away from the central axis of said side bearing assembly, with each flange portion defining an aperture therein.

6. The railroad car constant contact side bearing assembly according to claim 5 wherein, said housing further includes a post extending upwardly from base for a predetermined distance, and wherein said cap includes a depending post generally aligned with the post of said housing for limiting reciprocatory movement of said cap toward said housing during operation of said railroad car constant contact side bearing assembly.

7. A railroad car constant contact side bearing assembly adapted to be disposed intermediate a bolster and a car body of a railroad vehicle, said constant contact side bearing assembly comprising:

a cap having a generally planar surface configured to contact and slide along an underside of said car body, with said cap further including wall structure formed integral with and depending from said generally planar surface so as to define an open-bottom cavity;

a spring for continually urging the generally planar surface on said cap into sliding contact with the underside of said car body;

a housing formed from high performance plastic having an open-top upstanding wall structure defining a non-metal sliding surface which guides and promotes vertical reciprocatory movements of the wall structure of said cap relative to said housing, with the open-top wall structure of said housing and the open-bottom wall structure of said cap combining to define a void wherein said spring is accommodated; and a metal skeleton arranged in operable combination with said plastic housing; said skeleton including a base and wall structure extending upwardly from said base and embedded within and adding strength to at least a segment of the upstanding wall structure of said housing, with said metal skeleton defining two apertures for allowing fasteners to pass therethrough so as to allow said side bearing assembly to be secured to an upper surface of a bolster on said railcar.

8. The railroad car constant contact side bearing assembly according to claim 7 wherein, said housing and said cap define cooperating instrumentalities for guiding said cap for vertical reciprocatory movements relative to said housing and for maintaining a predetermined relation between said cap and said housing.

9. The railroad car constant contact side bearing assembly according to claim 7 wherein, the wall structure of said skeleton includes at two vertically upright projections extending from and formed integral with said base, with each projection terminating at an upper end of the wall structure on said housing for limiting reciprocatory movement of said cap toward said housing during operation of said railroad car constant contact side bearing assembly.

10. The railroad car constant contact side bearing assembly according to claim 7 wherein, said spring is formed from a thermoplastic elastomer.

11. The railroad car constant contact side bearing assembly according to claim 10 wherein, the wall structure of said cap defines openings arranged toward an intersection of the generally planar surface and the wall structure of said cap so as to remain substantially unobstructed by the underside of said railcar body during operation of said side bearing assembly, with said openings being in communication with the open-bottom cavity defined by said cap to dissipate heat from said cavity during operation of said side bearing assembly.

12. The railroad car constant contact side bearing assembly according to claim 11 wherein, said plastic housing defines openings toward a bottom thereof and which are arranged in communication with the open-top cavity defined by said housing, with the openings in said plastic housing and the openings in said cap defining an air passage between the bottom of said housing and the openings in said cap to promote the dissipation of heat away from said elastomeric spring during operation of said side bearing assembly.

13. A railroad car constant contact side bearing assembly adapted to be disposed intermediate a bolster and a car body of a railroad vehicle, said constant contact side bearing assembly comprising:

a cap having a generally planar surface configured to contact and slide along an underside of said car body, with said cap further including wall structure formed integral with and depending from said generally planar surface so as to define an open-bottom cavity;

a spring for continually urging the generally planar surface on said cap into sliding contact with the underside of said car body;

a housing formed from high performance plastic having an open-top upstanding wall structure defining a non-metal sliding surface which guides and promotes vertical reciprocatory movements of the wall structure of said cap relative to said housing, with the open-top wall structure of said housing and the open-bottom wall structure of said cap combining to define a void wherein said spring is accommodated; and a metal skeleton arranged in operable combination with said plastic housing; said skeleton including a two-piece structure, with each piece of said skeleton including a base and a projection extending upwardly from said base and embedded within and adding strength to at least a segment of the upstanding wall structure of said housing, with the base of each two piece structure defining an aperture for allowing a fastener to pass therethrough so as to allow said side bearing assembly to be secured to an upper surface of a bolster on said railcar.

14. The railroad car constant contact side bearing assembly according to claim 13 wherein, said housing and said cap define cooperating instrumentalities for guiding said cap for vertical reciprocatory movements relative to said housing and for maintaining a predetermined relation between said cap and said housing.

15. The railroad car constant contact side bearing assembly according to claim 13 wherein, the projection on each piece of said two-piece structure terminates at an upper end of the wall structure on said housing for limiting reciprocatory movement of said cap toward said housing during operation of said railroad car constant contact side bearing assembly.

16. The railroad car constant contact side bearing assembly according to claim 13 wherein, said spring is formed from a thermoplastic elastomer.

17. The railroad car constant contact side bearing assembly according to claim 16 wherein, said cap defines openings arranged toward an intersection of the generally planar surface and wall structure of said cap, with said openings remaining substantially unobstructed by the underside of said railcar body during operation of said side bearing assembly, and with said openings being in communication with the open-bottom cavity defined by said cap to dissipate heat from said cavity during operation of said side bearing assembly.

18. The railroad car constant contact side bearing assembly according to claim 17 wherein, said plastic housing defines openings toward a bottom thereof and which are arranged in communication with the open-top cavity defined by said housing, with the openings in said plastic housing and the openings in said cap defining an air passage between the bottom of said housing and the openings in said cap to promote the dissipation of heat away from said elastomeric spring during operation of said side bearing assembly.

19. A railroad car constant contact side bearing assembly adapted to be disposed intermediate a bolster and a car body of a railroad vehicle, said constant contact side bearing assembly comprising:

a non-metallic cap having a generally planar upper surface and wall structure depending from said generally planar upper surface, with the wall structure of said cap defining an open-bottom cavity;

a metallic insert maintained in operable association with the generally flat surface on said cap to slidably contact with an underside of said railcar whereby allowing said side bearing assembly to establish a coefficient of friction ranging between about 0.4 and about 0.9 with the railcar during operation of said constant contact side bearing assembly;

a housing formed from high performance plastic having an open-top upstanding wall structure defining a non-metal sliding surface which guides and promotes vertical reciprocatory movements of the wall structure of said cap relative to said housing, with the open-top wall structure of said housing and the open-bottom wall structure of said cap combining to define a void wherein a spring used to urge the cap toward an underside of the car body is accommodated; and a metal skeleton arranged in operable combination with said plastic housing; said skeleton including wall structure extending embedded within and adding strength to at least a segment of the upstanding wall structure of said housing, with said metal skeleton defining two apertures for allowing fasteners to pass therethrough so as to allow said side bearing assembly to be secured to an upper surface of a bolster on said railcar.

20. The railroad car constant contact side bearing assembly according to claim 19 wherein, the insert maintained in operable association with said cap is formed from a metal material selected from the class of: steel and austempered ductile iron.

21. The railroad car constant contact side bearing assembly according to claim 19 wherein, said housing and said cap define cooperating instrumentalities for guiding said cap for vertical reciprocatory movements relative to said housing and for maintaining a predetermined relation between said cap and said housing.

22. The railroad car constant contact side bearing assembly according to claim 19 wherein, said spring includes an elastomeric member having first and second axially aligned ends.

23. The railroad car constant contact side bearing assembly according to claim 19 wherein, said metal skeleton includes an elongated base and a post extending upwardly from base for a predetermined distance, with said base defining two apertures for allowing a fastener to pass through each aperture whereby securing said side bearing assembly to an upper surface of a bolster on said railcar, and wherein the insert on said cap further includes a depending post generally aligned with the post of said skeleton for limiting reciprocatory movement of said cap toward said housing during operation of said railroad car constant contact side bearing assembly.

24. The railroad car constant contact side bearing assembly according to claim 19 wherein, said skeleton includes a two-piece structure, with each piece of said skeleton including a base and a projection extending upwardly from said base and embedded within and adding strength to a segment of the upstanding wall structure of said housing, with the base of each two piece structure defining an aperture for allowing a fastener to pass therethrough so as to allow said side bearing assembly to be secured to an upper surface of a bolster on said railcar.

25. The railroad car constant contact side bearing assembly according to claim 19 wherein, said spring is formed from a thermoplastic elastomer.

26. The railroad car constant contact side bearing assembly according to claim 25 wherein, said cap defines openings arranged toward an intersection of the generally planar surface and the wall structure of said cap, with said openings in said cap remaining substantially unobstructed by the underside of said railcar body during operation of said side bearing assembly, and with said openings in said cap being in communication with the open-bottom cavity defined by said cap to dissipate heat from said cavity during operation of said side bearing assembly.

27. The railroad car constant contact side bearing assembly according to claim 26 wherein, said plastic housing defines openings toward a bottom thereof and which are arranged in communication with the open-top cavity defined by said housing, with the openings in said plastic housing and the openings in said cap defining an air passage between the bottom of said housing and the openings in said cap to promote the dissipation of heat away from said elastomeric spring during operation of said side bearing assembly.

* * * * *